US011423869B2

(12) United States Patent
Farha et al.

(10) Patent No.: US 11,423,869 B2
(45) Date of Patent: Aug. 23, 2022

(54) VIOLIN SHOULDER REST WITH MOVABLE PAD OR INDEPENDENTLY ADJUSTABLE MODULAR PADS

(71) Applicant: The Kun Shoulder Rest Inc., Ottawa (CA)

(72) Inventors: Juliana Farha, London (GB); Aled James, Warwick (GB)

(73) Assignee: The Kun Shoulder Rest Inc.

( * ) Notice: Subject to any disclaimer, the term of this patent is extended or adjusted under 35 U.S.C. 154(b) by 0 days.

(21) Appl. No.: 17/193,208

(22) Filed: Mar. 5, 2021

(65) Prior Publication Data

US 2021/0280158 A1 Sep. 9, 2021

Related U.S. Application Data

(60) Provisional application No. 62/986,371, filed on Mar. 6, 2020.

(51) Int. Cl.
*G10D 3/18* (2020.01)

(52) U.S. Cl.
CPC ..... *G10D 3/18* (2013.01)

(58) Field of Classification Search
CPC ..... G10D 3/00; G10D 3/18
See application file for complete search history.

(56) References Cited

U.S. PATENT DOCUMENTS

| | | | | |
|---|---|---|---|---|
| 3,728,928 | A | 4/1973 | Looser, nee Menge et al. | |
| 5,567,893 | A | 10/1996 | Kun | |
| 6,369,303 | B1 * | 4/2002 | Hvezda | G10D 3/18 84/278 |
| 8,957,290 | B2 | 2/2015 | Vochezer | |
| 2013/0276611 | A1 * | 10/2013 | Vochezer | G10D 3/18 84/280 |

FOREIGN PATENT DOCUMENTS

| | | | |
|---|---|---|---|
| CA | 2181115 | A1 | 5/1997 |
| CA | 2821831 | A1 | 6/2012 |
| CA | 3070075 | A1 | 8/2019 |
| DE | 2443940 | | 1/1976 |
| GB | 2052828 | A | 1/1981 |
| WO | 2019161332 | A1 | 8/2019 |

* cited by examiner

*Primary Examiner* — Kimberly R Lockett
(74) *Attorney, Agent, or Firm* — Condo Roccia Koptiw LLP

(57) ABSTRACT

A shoulder rest for a violin or viola comprises a bridge beam having a first end and a second end and a shoulder-engaging pad mounted to a block having a beam-engaging portion that is shaped to slide over the bridge beam. The shoulder rest includes a first foot disposed at the first end for gripping the violin or viola and a second foot disposed at the second end for gripping the violin or viola. In another implementation, the shoulder rest includes a first shoulder-engaging pad mounted to a first arm that is connected to an arm carriage disposed within a groove in the bridge beam and a second shoulder-engaging pad mounted to a second arm that is connected to the arm carriage.

16 Claims, 28 Drawing Sheets

VIOLIN SHOULDER REST WITH MOVABLE PAD OR INDEPENDENTLY ADJUSTABLE MODULAR PADS

CROSS-REFERENCE TO RELATED APPLICATIONS

This application claims priority from U.S. Provisional Patent Application 62/986,371 filed Mar. 6, 2020.

TECHNICAL FIELD

The present invention relates generally to shoulder rests for violins or violas.

BACKGROUND

A shoulder rest is an accessory device that can be attached to a violin or viola. Typically, the shoulder rest has fork-shaped clamping members or "feet" for detachably mounting the shoulder rest to the sides of the back of the violin or viola. The shoulder rest spaces the instrument at a comfortable height for the musician. The shoulder rest may have a body profile that generally conforms to the natural curves of the human shoulder and clavicle.

To accommodate both instruments of different sizes and musicians' body structures and posture preferences, some shoulder rests are adjustable in height and distance between the fork-shaped clamping members.

Some examples of adjustable shoulder rests are disclosed in U.S. Pat. No. 5,270,474 (Kun) entitled "Violin or the Like Shoulder Rest", U.S. Pat. No. 5,419,226 (Kun) entitled "Violin Shoulder Rest", U.S. Pat. No. 5,567,893 (Kun) entitled "Shoulder Rest for Violin or Like Instrument", U.S. Pat. No. 6,031,163 (Cullum et al.) entitled "Adjustable Shoulder Rest for Violins or the Like", U.S. Pat. No. 7,265,284 (Muir et al) entitled "Violin or the Like Instrument" which are all incorporated herein by reference.

To permit more compact storage, some shoulder rests are foldable (or "collapsible") such as the one disclosed in U.S. Pat. No. 5,731,531 (Kun) entitled "Shoulder Rest for Violin or Like Instrument" which is incorporated herein by reference.

The body or bridge of the shoulder rest may be made of different materials such as polymers, composite materials, metals, or woods. U.S. Pat. No. 6,291,750 (Farha) entitled "Bridge for a Violin or Viola Shoulder Rest", which is incorporated herein by reference, discloses a body or bridge made of a laminate that includes a plurality of wood veneers.

Other improvements in shoulder rest ergonomics are disclosed in U.S. Pat. No. 7,385,124 (Clemente) entitled "Clamping Member for a Violin Shoulder Rest" and U.S. Pat. No. 9,311,903 (Balatti) entitled "Adjustable and Foldable Shoulder Rest for Violin or Viola" which are incorporated herein by reference.

Although adjustable and foldable shoulder rests are known in the art, further improvements in adjustability and ergonomics remain highly desirable.

SUMMARY

Disclosed herein are novel shoulder rests. In one embodiment, the shoulder rest has a shoulder-engaging pad that is decoupled from the bridge so as to slide relative to the bridge. The pad may be mounted to a block having a beam-engaging portion that is shaped to slide over the bridge beam. In another embodiment, the shoulder rest has independently adjustable modular pads. In this embodiment, first and second shoulder-engaging pads each mounted to respective arms are connected to one or two arm carriages that move relative to the bridge beam, e.g. translate within a groove in the bridge beam. In a further embodiment, the pad comprises a freeform inelastically deformable material, e.g. a freeform mesh, that is inelastically deformable into a plurality of shoulder-conforming shapes.

Accordingly, one inventive aspect of the present disclosure is a shoulder rest for a violin or viola that includes a bridge beam having a first end and a second end and a shoulder-engaging pad adjustable relative to the bridge beam. The shoulder rest includes a first foot disposed at the first end for gripping the violin or viola and a second foot disposed at the second end for gripping the violin or viola.

Another inventive aspect of the present disclosure is a shoulder rest for a violin or viola that includes a bridge beam having a first end and a second end, a first shoulder-engaging pad and a second shoulder-engaging pad that are each independently adjustable relative to the bridge beam. The shoulder rest further includes a first foot disposed at the first end for gripping the violin or viola and a second foot disposed at the second end for gripping the violin or viola.

This summary is provided to highlight certain significant inventive aspects but is not intended to be an exhaustive or limiting definition of all inventive aspects of the disclosure. Other inventive aspects may be disclosed in the detailed description and drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
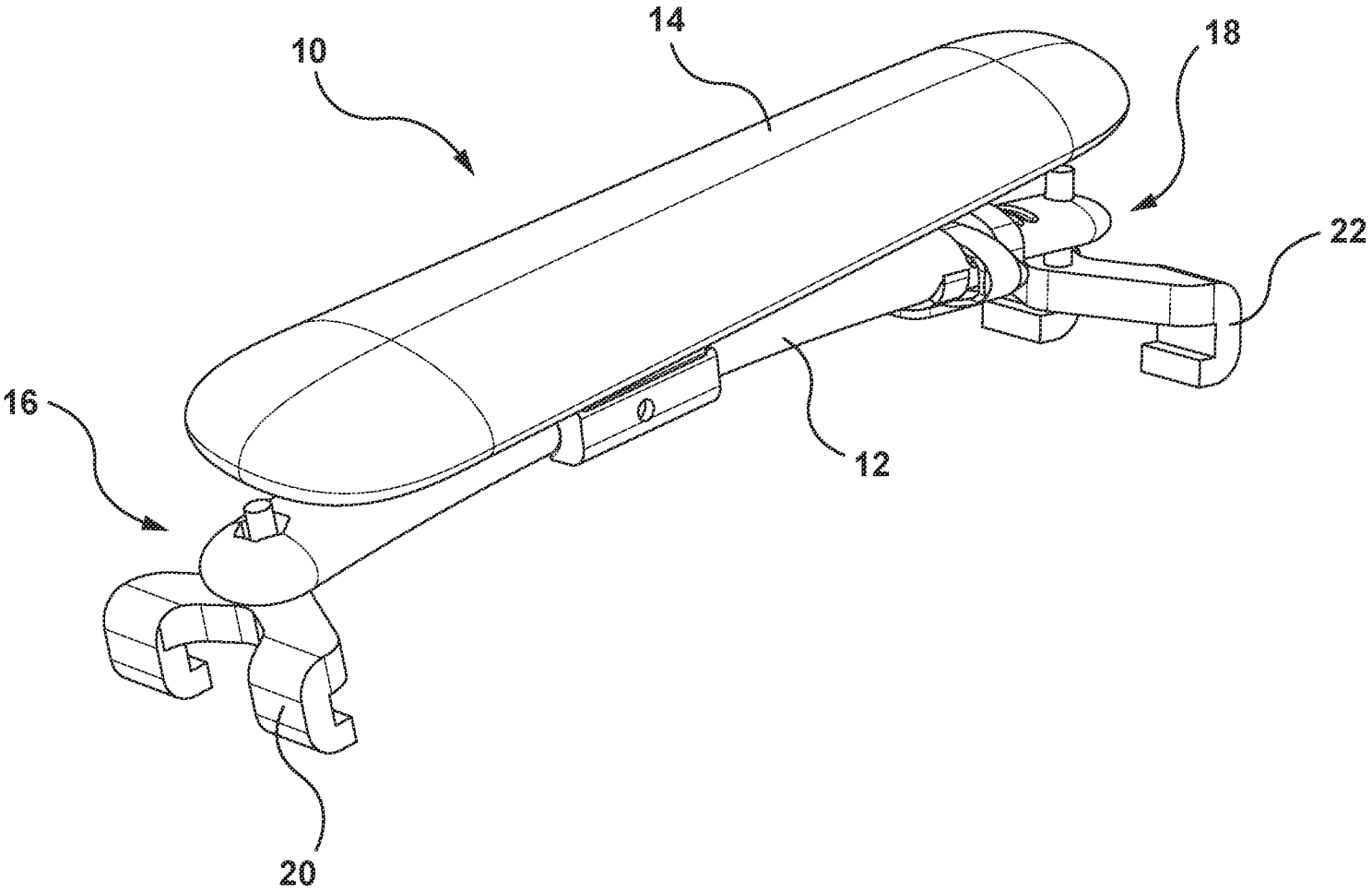
FIG. 1 is an isometric view of a shoulder rest having a shoulder-engaging pad mounted to a block having a beam-engaging portion that is shaped to slide over the bridge beam.
Figure 2:
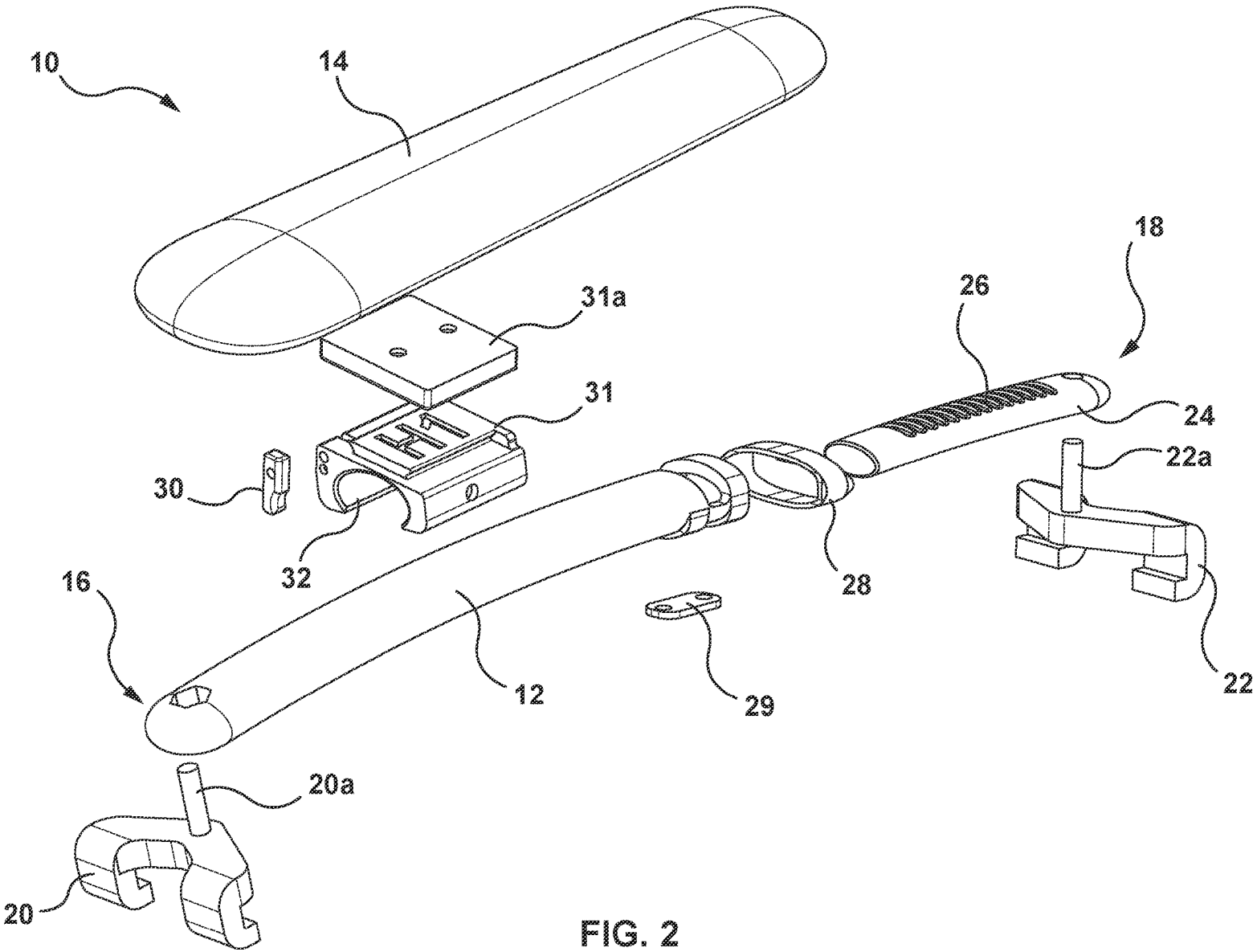
FIG. 2 is an exploded view of the shoulder rest of FIG. 1.
Figure 3:
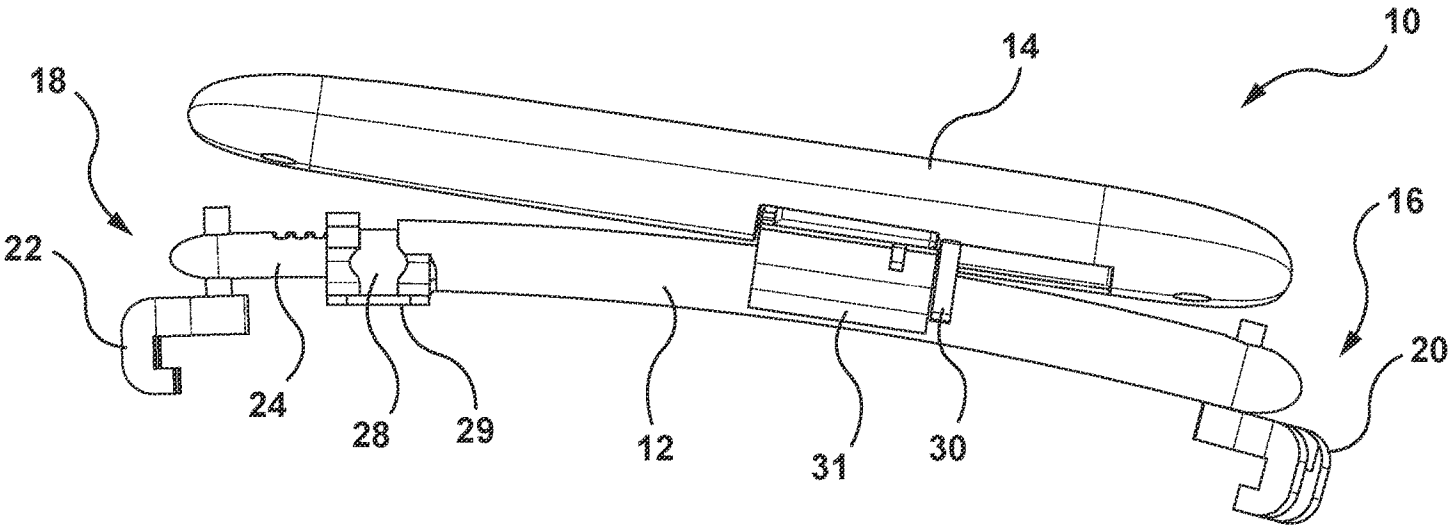
FIG. 3 is a side view of the shoulder rest of FIG. 1.
Figure 4:
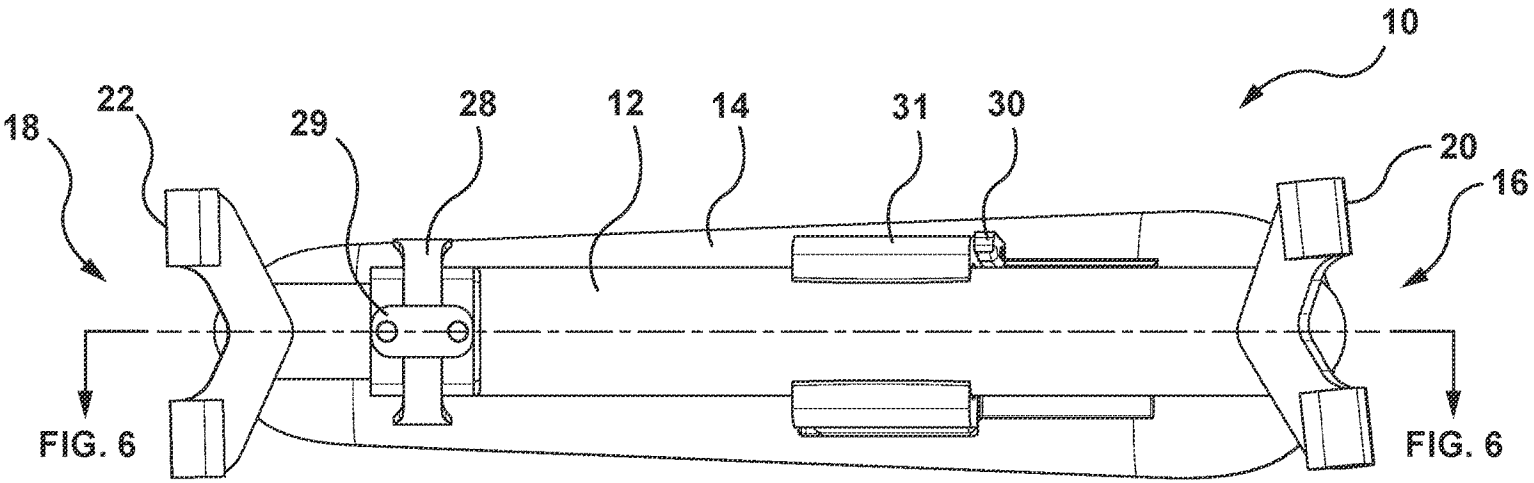
FIG. 4 is a top view of the shoulder rest of FIG. 1.
Figure 5:
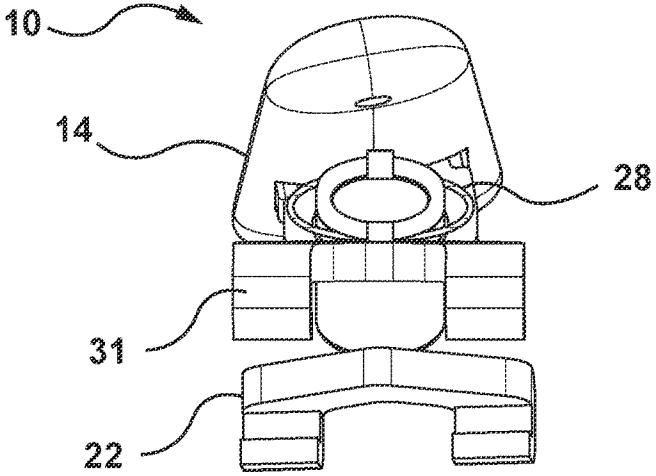
FIG. 5 is an end view of the shoulder rest of FIG. 1.
Figure 6:
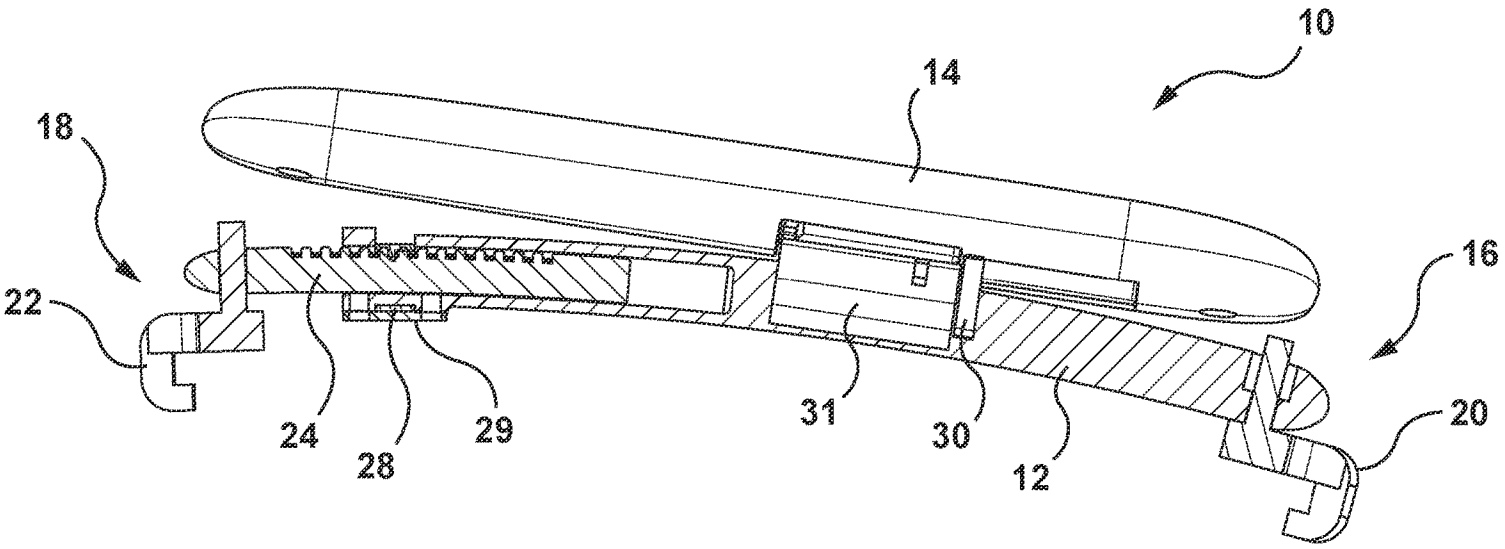
FIG. 6 is a cross-sectional view taken through section A-A of FIG. 4.
Figure 7:
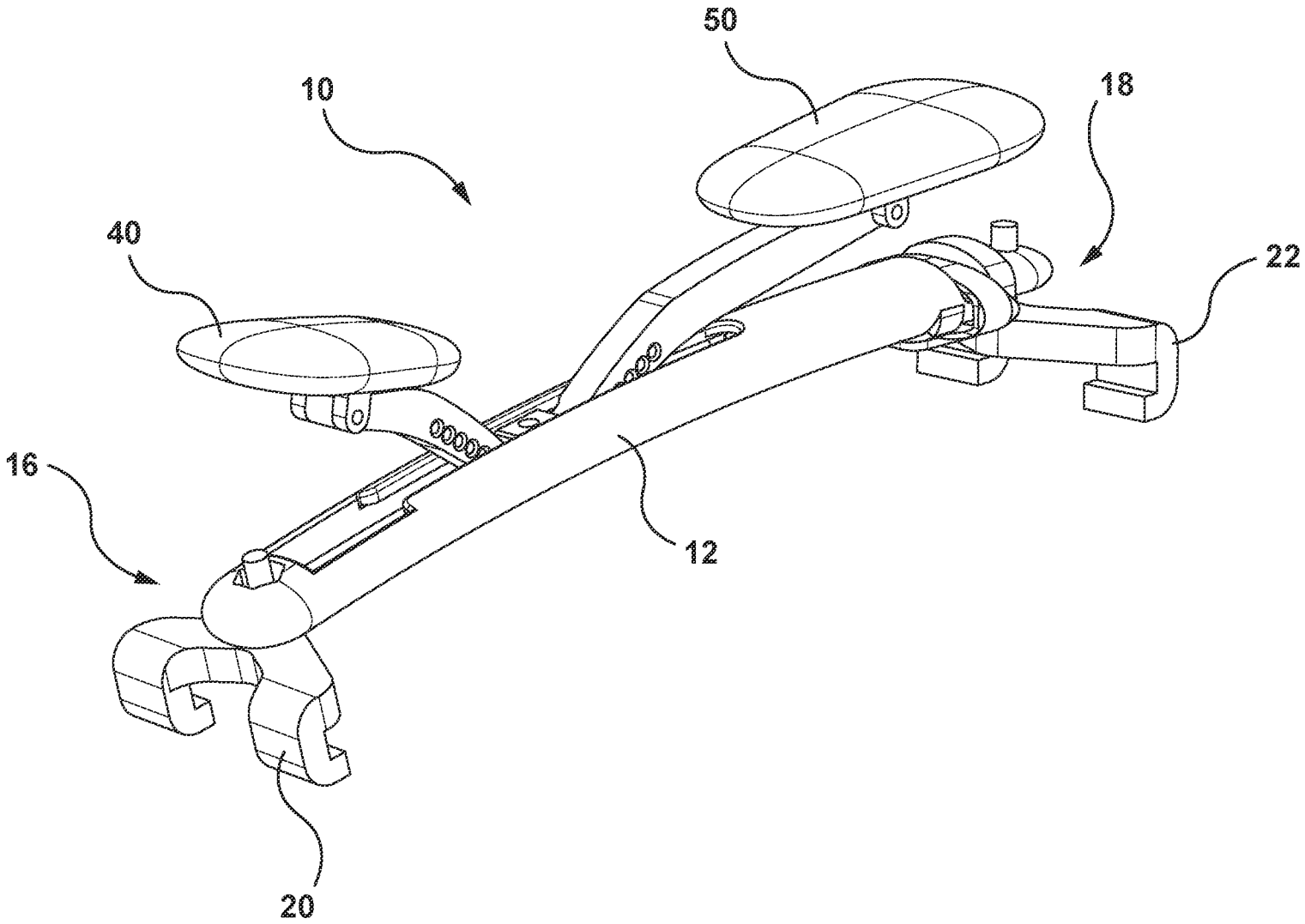
FIG. 7 is an isometric view of a shoulder rest having first and second shoulder-engaging pads each mounted to respective arms that are connected to an arm carriage disposed within a groove in the bridge beam.
Figure 8:
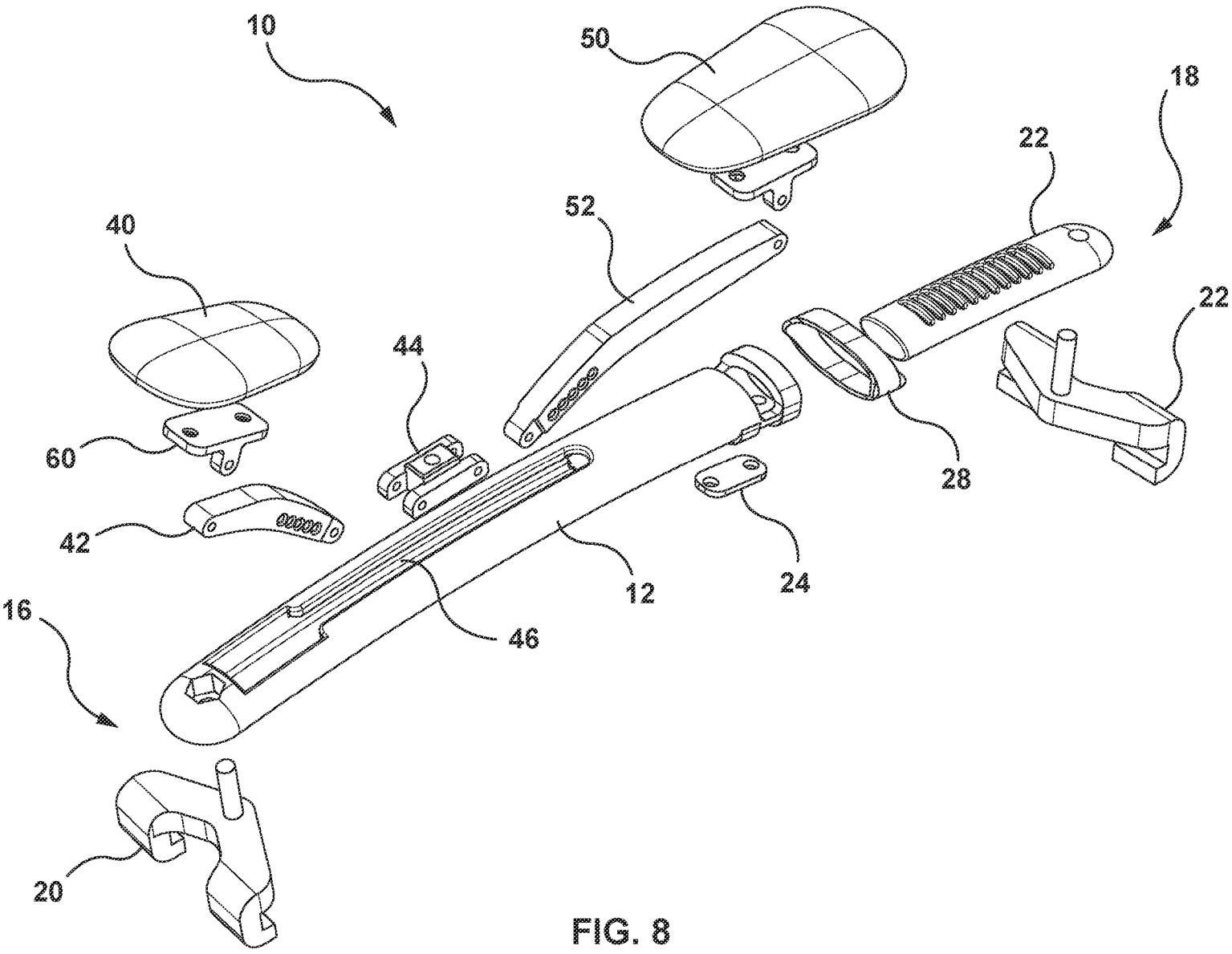
FIG. 8 is an exploded view of the shoulder rest of FIG. 7.
Figure 9:
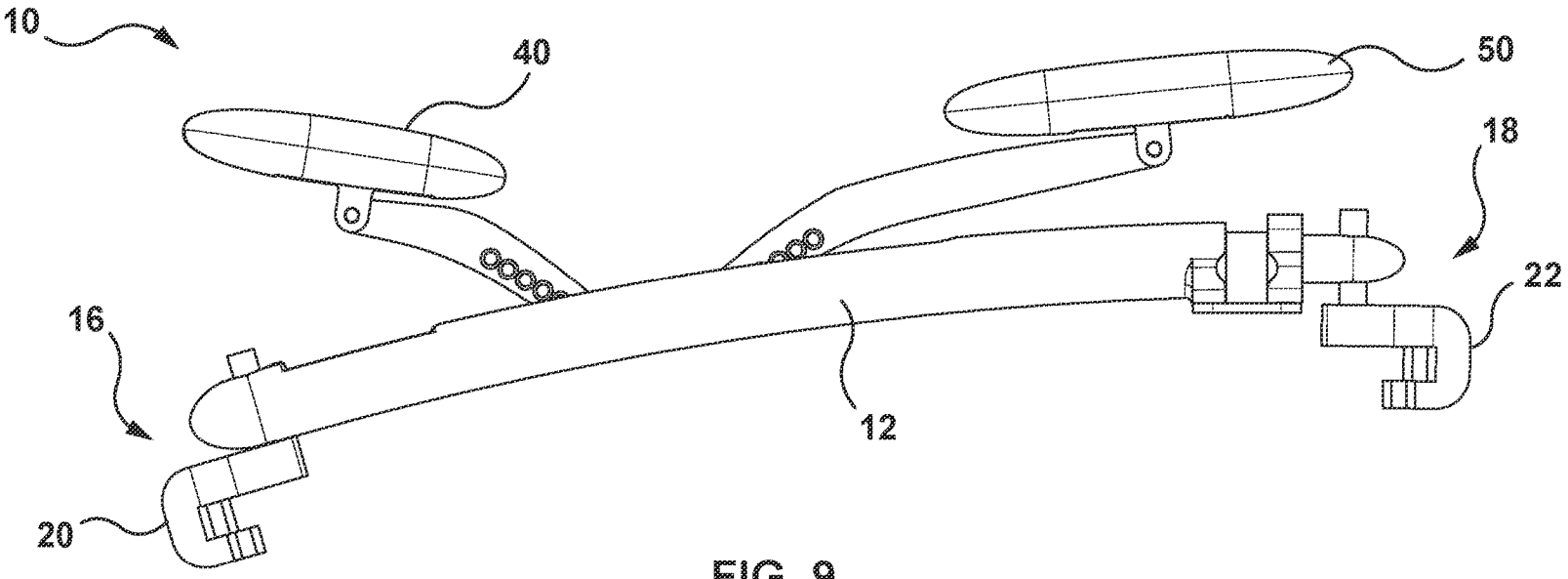
FIG. 9 is a side view of the shoulder rest of FIG. 7.
Figure 10:
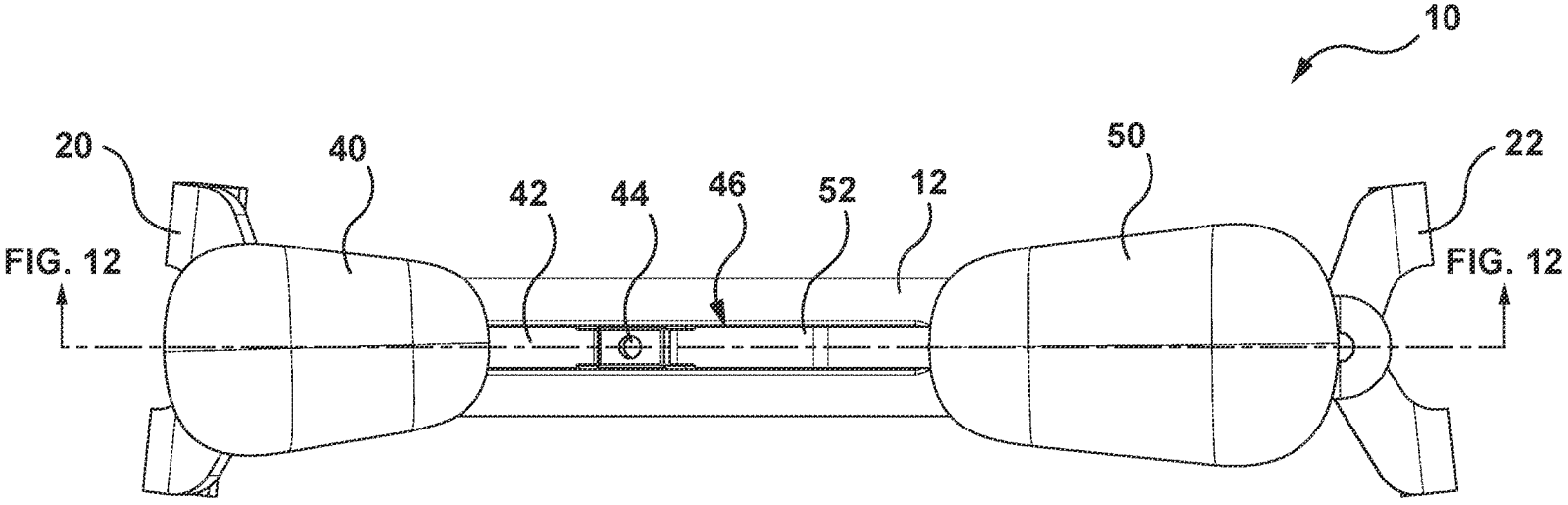
FIG. 10 is a top view of the shoulder rest of FIG. 7.
Figure 11:
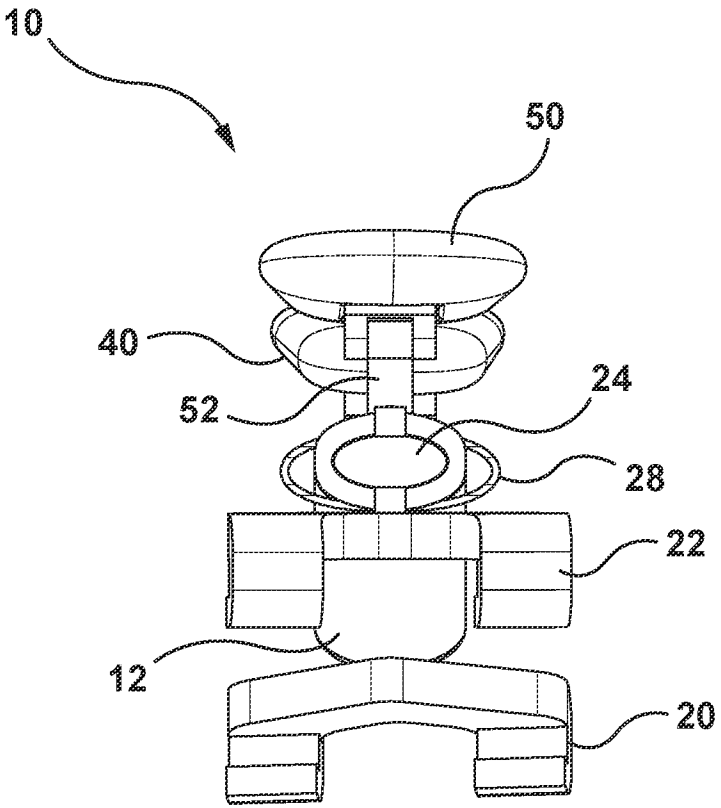
FIG. 11 is an end view of the shoulder rest of FIG. 7.
Figure 12:
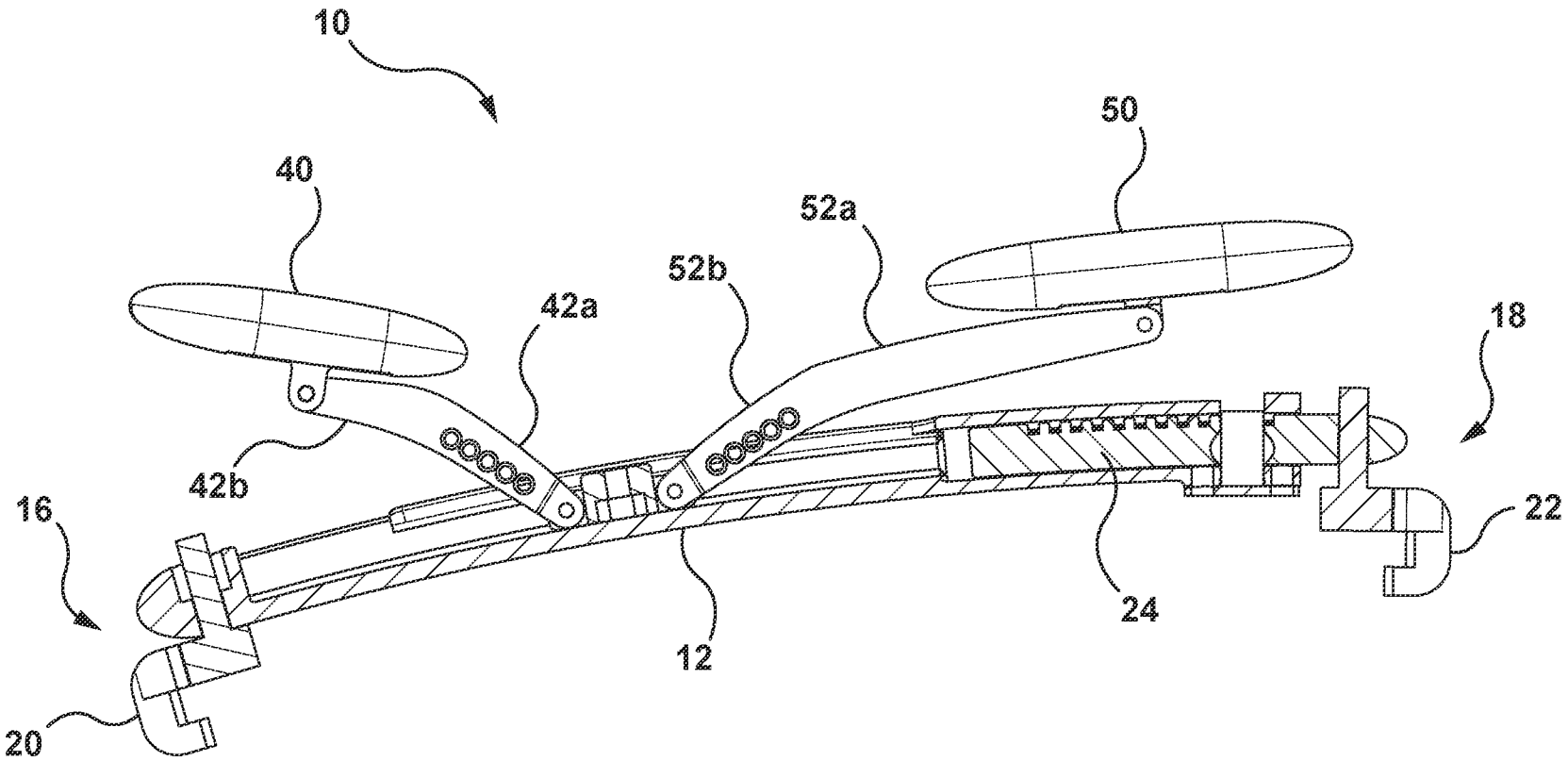
FIG. 12 is a cross-sectional view taken through section A-A of FIG. 10.
Figure 13:
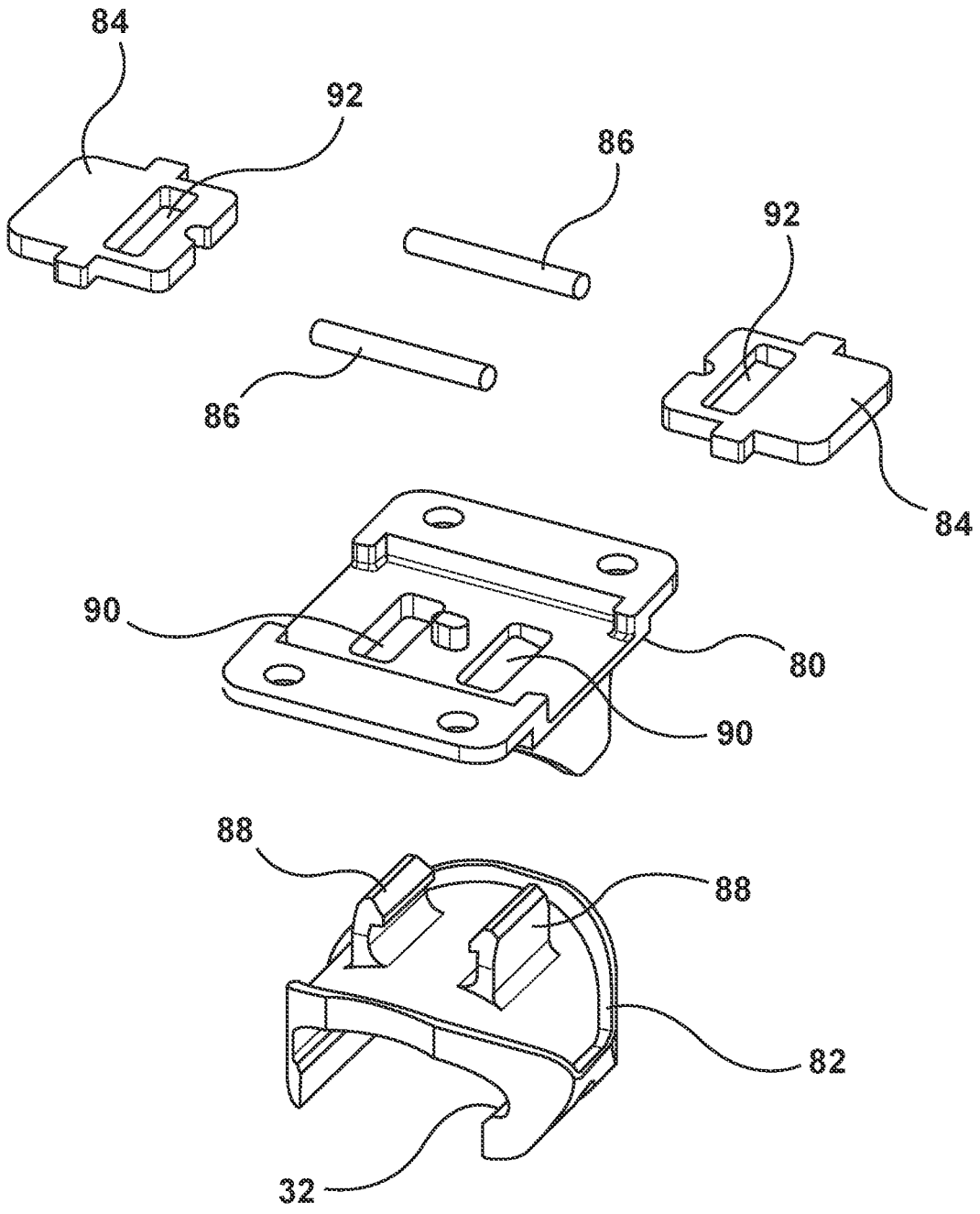
FIG. 13 is an exploded view of a quick-release mechanism.
Figure 14:
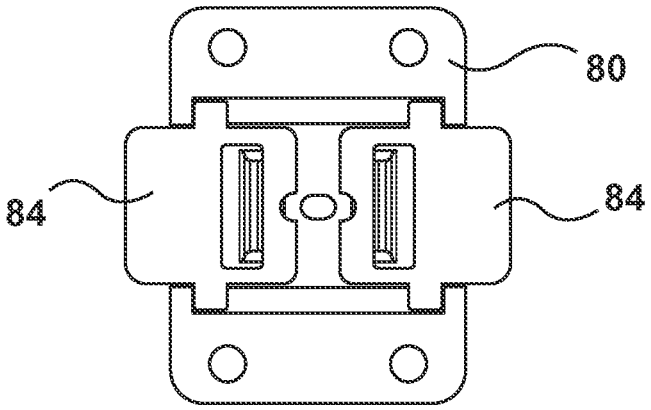
FIG. 14 is a top view of the quick-release mechanism of FIG. 13.
Figure 15:
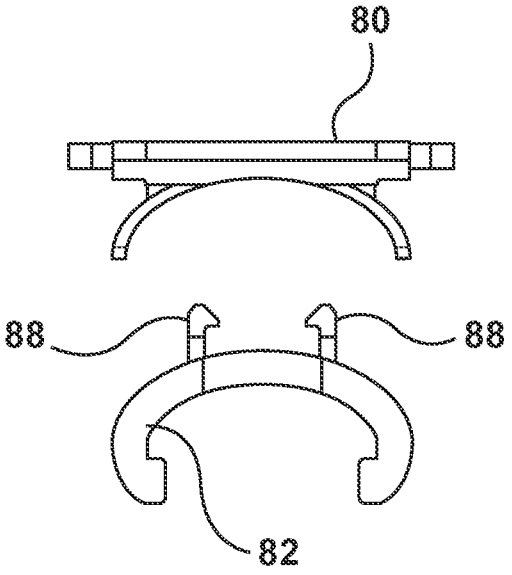
FIG. 15 is an end view of two disassembled components of the bottom member.
Figure 16:
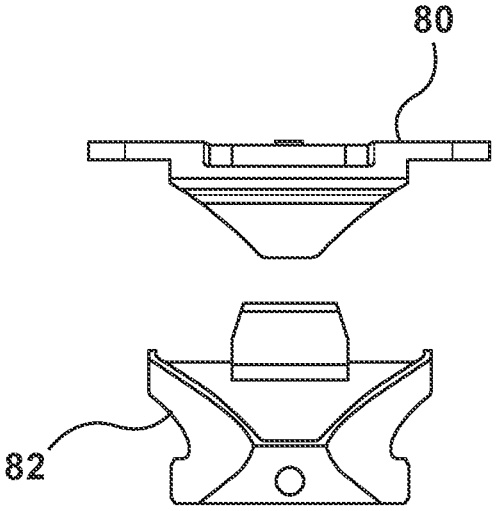
FIG. 16 is a side view of two disassembled components of the upper member.

FIGS. 1-6 depict an adjustable shoulder rest for a violin or viola in accordance with an embodiment of the present invention. In the embodiment depicted in FIGS. 1-6, the shoulder rest has a shoulder-engaging pad that is mechanically decoupled from a bridge beam so as to slide relative to the bridge beam. The pad may be mounted to a block (also referred to herein as a bridge block or bridge block assembly) having a beam-engaging portion that is shaped to slide over the bridge beam.

As depicted in FIGS. 1-6, the shoulder rest, which is denoted generally by reference numeral 10, includes a bridge beam 12 and a shoulder-engaging pad 14. The bridge beam 12 has a first end 16 and a second end 18. The pad 14 has an instrument-facing side and a shoulder-engaging side designed to rest upon a shoulder of a musician while playing the violin or viola. A first foot (also referred to herein as a fork or fork-shaped clamping member) 20 having a first pair of tines, prongs or fingers is disposed at the first end 16 of the bridge beam 12 for gripping the violin or viola. A second foot (or fork or fork-shaped clamping member) 22 having a second pair of tines, fingers or prongs is disposed at the second end 18 of the bridge beam for gripping the violin or viola. The first and second feet 20, 22 may be rotatable relative to the bridge beam. In the illustrated embodiment, the first foot has a first stem 20*a*, e.g. a cylindrical shaft, that fits rotationally within a first correspondingly sized hole or socket formed in the bridge beam. The second foot has a first second 22*a*, e.g. a cylindrical shaft, that fits rotationally within a second correspondingly sized hole or socket formed in the bridge beam. The stem 20*a*, 22*a* of each foot 20, 22 thus enables rotation of the foot 20, 22 relative to the bridge beam 12 to provide adjustability.

The bridge beam 12 of the shoulder rest depicted in FIGS. 1-6 further includes an extensible foot beam 24 that extends from the bridge beam 12 to define the second end 18. The foot beam includes a ratchet 26 as shown in the illustrations although another functionally equivalent mechanism may be substituted. The shoulder rest 10 further comprises a ratchet ring 28 for interlocking with the ratchet. The ratchet ring 28 in one embodiment is squeezable to disengage the ratchet. In one embodiment, the ratchet ring may be a thin-walled elliptical collar that deforms when compressed by the musician's thumb and finger. In one embodiment, a ratchet ring mount 29 is provided to mount the ratchet ring.

In another embodiment, the ratchet ring provides both teeth to bite into the ratchet features, but also as a means of providing a return spring. In one embodiment, the ratchet features are separated from the ratchet ring. The ratchet teeth bite into the ratchet features whereas the ratchet ring provides the spring force to bias the ratchet features together.

In the illustrated embodiment, the bridge beam 12 is an elliptically shaped hollow beam. The bridge beam is constructed from a suitably rigid material such that it resists significant bending or torsion when subjected to the ordinary forces and torques that are exerted by a musician when playing a violin or viola. Furthermore, the acoustic properties of the shoulder rest, when attached to a violin or viola, are such that there are no deleterious effects on the sound generated by the violin or viola. The hollow beam provides a cavity in which the foot beam may be retracted. In a variant, the bridge beam may be partly solid with only a hollow portion or cavity at one end to accommodate the foot beam. In a further variant, the bridge beam may be solid in which case the foot beam could be a tubular structure that slides over the outer surface of the bridge beam. The bridge beam need not be tubular. In yet a further variant, the bridge beam may have another cross-sectional shape, such as U-shaped.

The shoulder-engaging pad 14 is mounted via a block 31 that includes or is connected to a pad slot adjustment bracket 31*a* for connecting to the bridge beam 12. In the illustrated embodiment, the block 31 has a concavely contoured beam-engaging portion defining a claw 32 that is shaped to slide over the bridge beam 12.

The shoulder rest 10 may further include a latch 30 to lock the block 31 relative to the bridge beam 12. The shoulder-engaging pad 14 can thus be adjusted by translating the pad 14 and the block 31 relative to the bridge beam 12. In one embodiment, the lower half of the block is fixed to the bridge beam during the setup procedure. The upper part of the block includes the quick-disconnect mechanism. In another embodiment, a thumb screw may be used to fix the block to the bridge beam. In yet another embodiments, blocks of different height may be interchangeably mounted to the bridge beam to provide different heights of the pad relative to the bridge beam.

The block of the shoulder rest 10 may also include a quick-disconnect mechanism to disengage the block from the bridge beam 12 to enable sliding of the shoulder-engaging pad 14 relative to the bridge beam 12. In one embodiment, the block quick-disconnect mechanism comprises the concavely contoured claw 32 to engage the bridge beam 12. The claw 32 is shaped to match the elliptical shape of the bridge beam 12. The quick-connect mechanism is further described below.

In one embodiment, the block may be angled relative to the bridge beam to angle the shoulder-engaging pad relative to the bridge beam, and thus relative to the feet and to the violin or viola to which the shoulder rest is attached. For example, in one implementation, the shoulder-engaging pad has a portion that slots into the block at a slight angle. It will be appreciated that the angle of the block may be varied and that a suitable mechanism may be provided to adjust the angle of the block relative to the bridge beam.

In one embodiment, the shoulder rest of FIGS. 1-6 includes a freeform inelastically deformable material that is inelastically deformable into a plurality of shoulder-conforming shapes. One example is a freeform mesh. The freeform inelastically deformable material may be part of the pad or attached to the pad. For the purposes of this specification, the expression "inelastically deformable" means that the freeform inelastically deformable material can be manually deformed by bending or twisting the freeform inelastically deformable material such that it remains in the deformed shape after releasing it. The freeform inelastically deformable material can be shaped to conform to the shoulder of the musician.

FIGS. 7-12 depict an adjustable shoulder rest for a violin or viola in accordance with another embodiment of the present invention. In the embodiment depicted in FIGS. 7-12, the shoulder rest has modular pads, i.e. first and second shoulder-engaging pads each mounted to respective arms that are connected to an arm carriage or respective arm carriages movable relative to the bridge beam, e.g. disposed within a groove in the bridge beam.

The two modular pads are independently movable to provide height adjustability without changing the heights of the feet, thereby keeping the bridge beam as close as possible to the violin or viola to which it is attached. This modular design provides minimal contact with both the violin or viola and with the shoulder of the musician. In one embodiment, the first shoulder-engaging pad is mounted to a first arm that is connected to an arm carriage disposed within a groove in the bridge beam and the second shoulder-engaging pad is mounted to a second arm that is connected to the arm carriage. In another embodiment, the first shoulder-engaging pad is mounted to a first arm that is connected to a first arm carriage that translates with respect to the bridge beam and the second shoulder-engaging pad is mounted to a second arm that is connected to a second arm carriage that translates independently of the first arm carriage with respect to the bridge beam.

The first and second arms may define first and second angles that are independently adjustable. The first and second arms may be pivotally mounted to first and second hinges that respectively support the first and second pads. The first and second arms may be independently height-adjustable. The modular design thus provides degrees of adjustability that are not possible with prior-art shoulder rests.

In the embodiment depicted in FIGS. 7-12, the shoulder rest 10 has a bridge beam 12. As described above, the bridge beam 12 includes the foot beam 24 that is extendable from within the bridge beam to define the second end. The first foot 20 is disposed at the first end of the bridge beam whereas the second foot 22 is disposed at the second end (on the foot beam). As was the case with the embodiment of FIGS. 1-6, the embodiment of FIGS. 7-12 the foot beam also comprises a ratchet that interlocks with a squeezable ratchet ring.

In the embodiment depicted in FIGS. 7-12, the shoulder rest includes a first shoulder-engaging pad 40 mounted to a first arm 42 that is connected to an arm carriage 44 disposed within a groove 46 in the bridge beam 12. The shoulder rest also includes a second shoulder-engaging pad 50 mounted to a second arm 52 that is connected to the arm carriage 44.

In the embodiment illustrated in FIGS. 7-12, the second arm 52 is longer than the first arm 42. In a variant, the first and second arms may have the same length. In a further variant, the first arm may be longer than the second arm.

In the embodiment illustrated in FIGS. 7-12, the second pad 50 is larger than the first pad 40. In a variant, the first and second pads are the same size. In a further variant, the first pad is larger than the second pad.

In the embodiment illustrated in FIGS. 7-12, the first and second arms 42, 52 are angled arms. Each angled arm is characterized by a proximal arm segment and a distal arm segment. The proximal arm segment is closest to the pad whereas the distal arm segment is furthest from the pad, i.e. closest to the bridge beam. Thus, the first arm 42 is characterized by a first proximal arm segment 42*a* and a first distal arm segment 42*b*. Analogously, the second arm 52 is characterized by a second proximal arm segment 52*a* and a second distal arm segment 52*b*. In the specific embodiment shown in the figures, the first proximal arm segment 42*a* and the first distal arm segment 42*b* define a first obtuse angle. Analogously, the second proximal arm segment 52*a* and the second distal arm segment 52*b* define a second obtuse angle. In the particular embodiment shown, the first obtuse angle and the second obtuse angle are different angles.

In the embodiment illustrated in FIGS. 7-12, the first shoulder-engaging pad 40 is mounted to a first pad hinge 60 which is, in turn, pivotally connected to a proximal end of the first arm 42. Analogously, the second shoulder-engaging pad 50 is mounted to a second pad hinge 70 which is, in turn, pivotally connected to a proximal end of the second arm 52.

FIGS. 13-16 depict a quick-release mechanism that may be used with the shoulder rest described herein, particularly with the embodiment depicted in FIGS. 1-6. As depicted in FIGS. 13-16, the quick-release mechanism includes an upper member 80, a bottom member 82 having a contoured portion that defines the claw 32 that was introduced above. The quick-release mechanism includes a pair of buttons 84 and a pair of parallel compression springs 86 that are disposed between the buttons 84. The bottom member 82 includes two upwardly protruding hooks 88 that fit into two spaced-apart generally rectangular slots 90 that are formed in the upper member. Similarly shaped and sized slots 92 are also formed in each of the two buttons 84 to connect the two buttons to each of the buttons to the upwardly protruding hooks 88. Compressing the buttons 84 causes compression of the compression springs which deforms the bottom member to release the gripping pressure on the bridge beam. Once the pad has been slid to its new position, the buttons 84 are released and the bottom member returns to its original posture (original shape), thereby exerting its gripping pressure on the bridge beam to retain the pad in that new location along the bridge beam.

Figure 17:
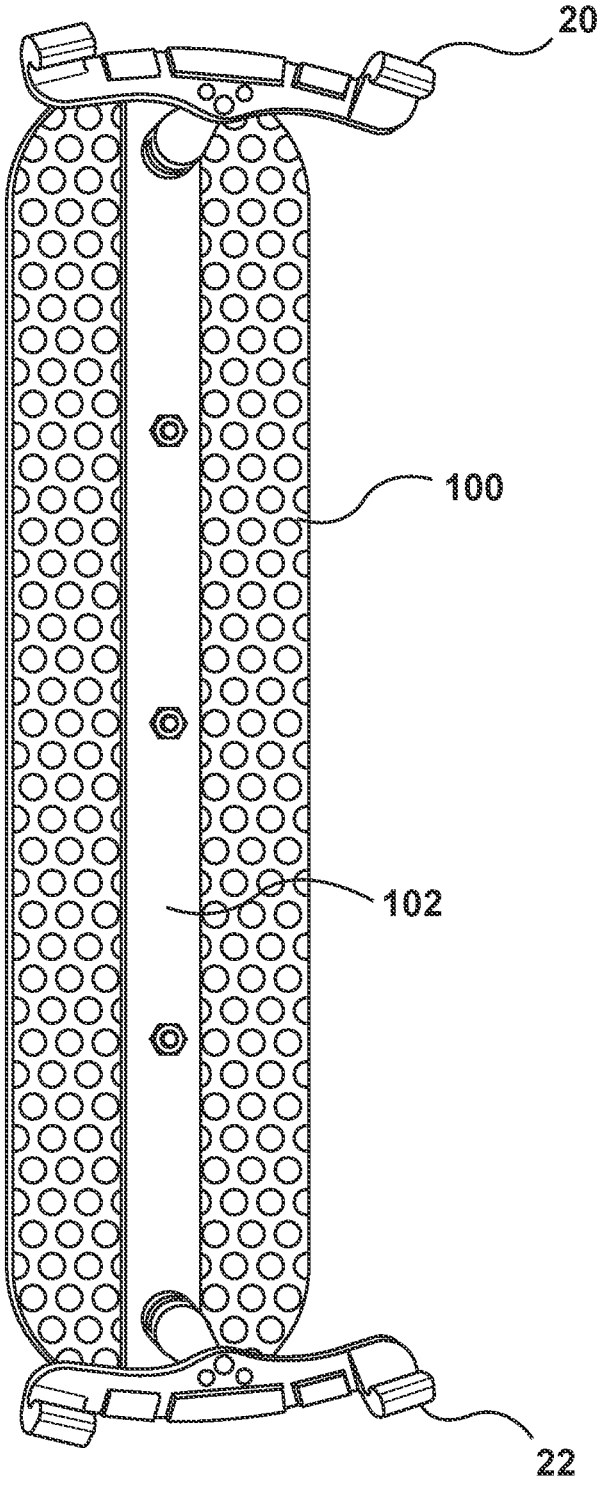
FIG. 17 is a top view of a freeform mesh in accordance with one embodiment.

FIG. 17 is a top view of a freeform mesh as one example of a freeform inelastically deformable material in accordance with one embodiment. The freeform mesh may be constructed as shown in this figure. In the embodiment depicted in FIG. 17, the freeform mesh 100 is connected to a backbone, support member or frame element 102. In this embodiment, the feet 20, 22 are mounted to the backbone 102. The freeform mesh is then covered with a pad or cushion for comfort. In one embodiment, the freeform mesh has a single layer of metal for providing deformability. In another embodiment, there are multiple layers of different materials and/or different material thicknesses and/or different perforation patterns to provide varying degrees of deformability in multiple axes. The freeform mesh can thus be made to be pliable in longitudinal and transverse directions in some embodiments. This enables the shoulder rest to be bent into various shapes such as a wave shape, a twist shape, a hook shape and an edge wave shape.

Figure 18:
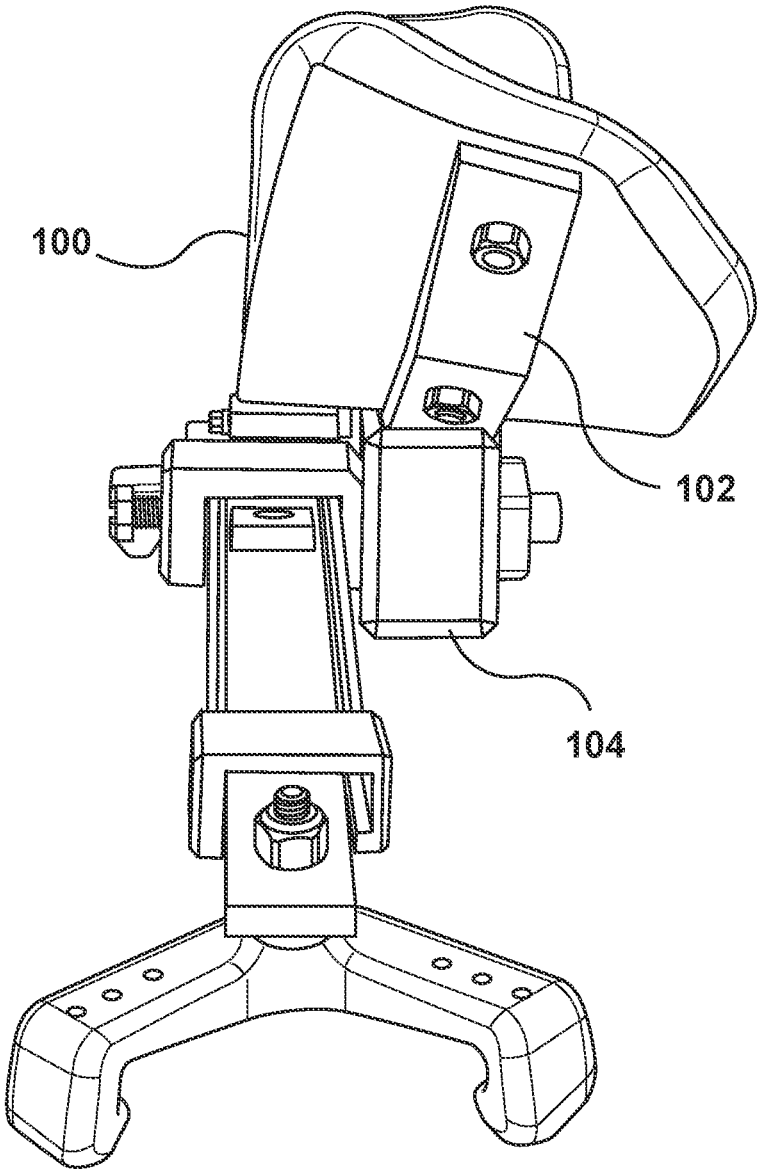
FIG. 18 is a view of a freeform mesh that is mounted offset relative to the bridge beam in accordance with another embodiment.

FIG. 18 is a view of the freeform mesh 100 and the backbone 102 that are mounted in an offset manner to the bridge beam. In this embodiment, the backbone 102 is mounted to an offset bracket 104 so that the freeform mesh 100 is offset laterally relative to the bridge beam.

Figure 30:
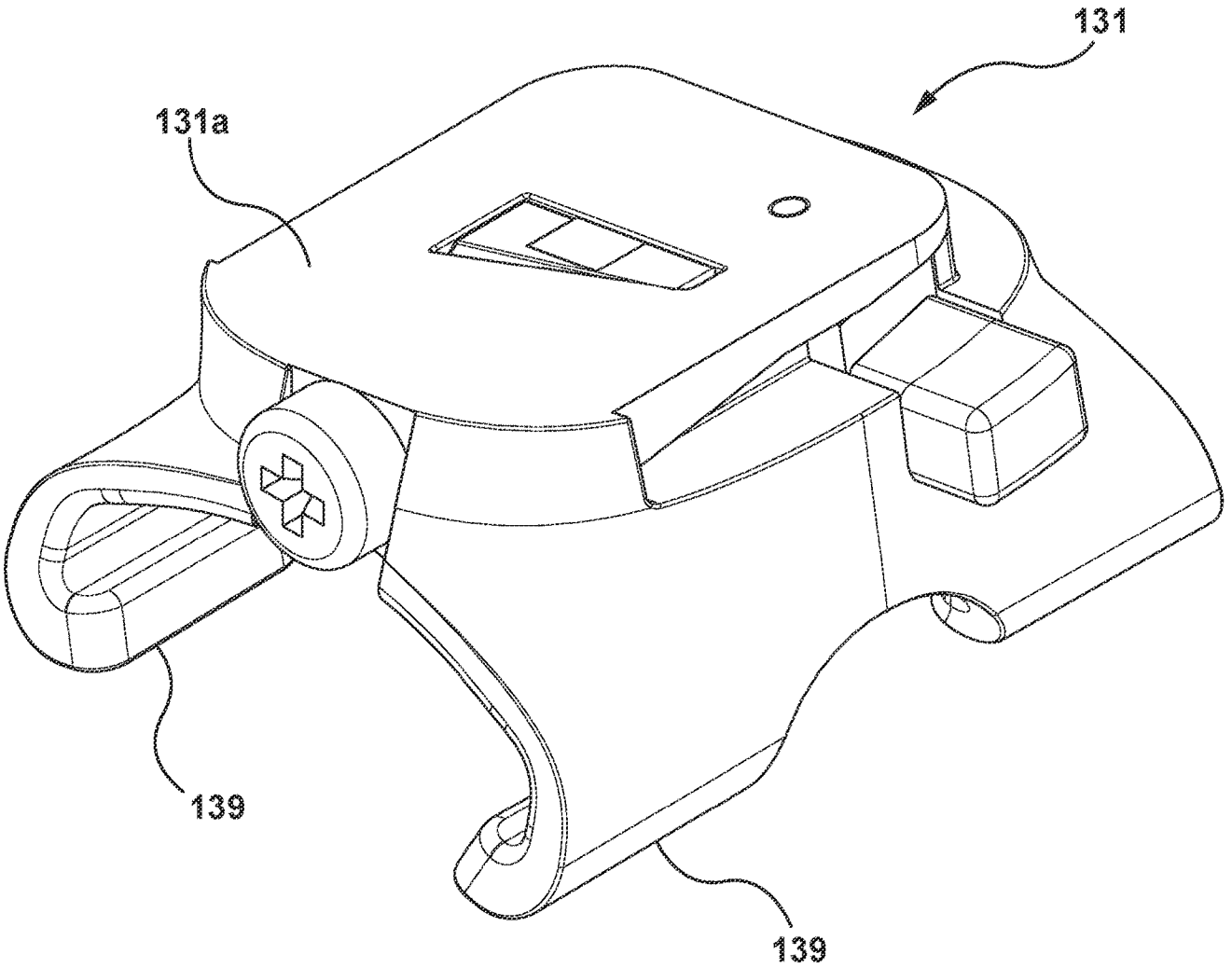
FIG. 30 is an isometric view of the bridge block assembly of FIG. 19.
Figure 31:
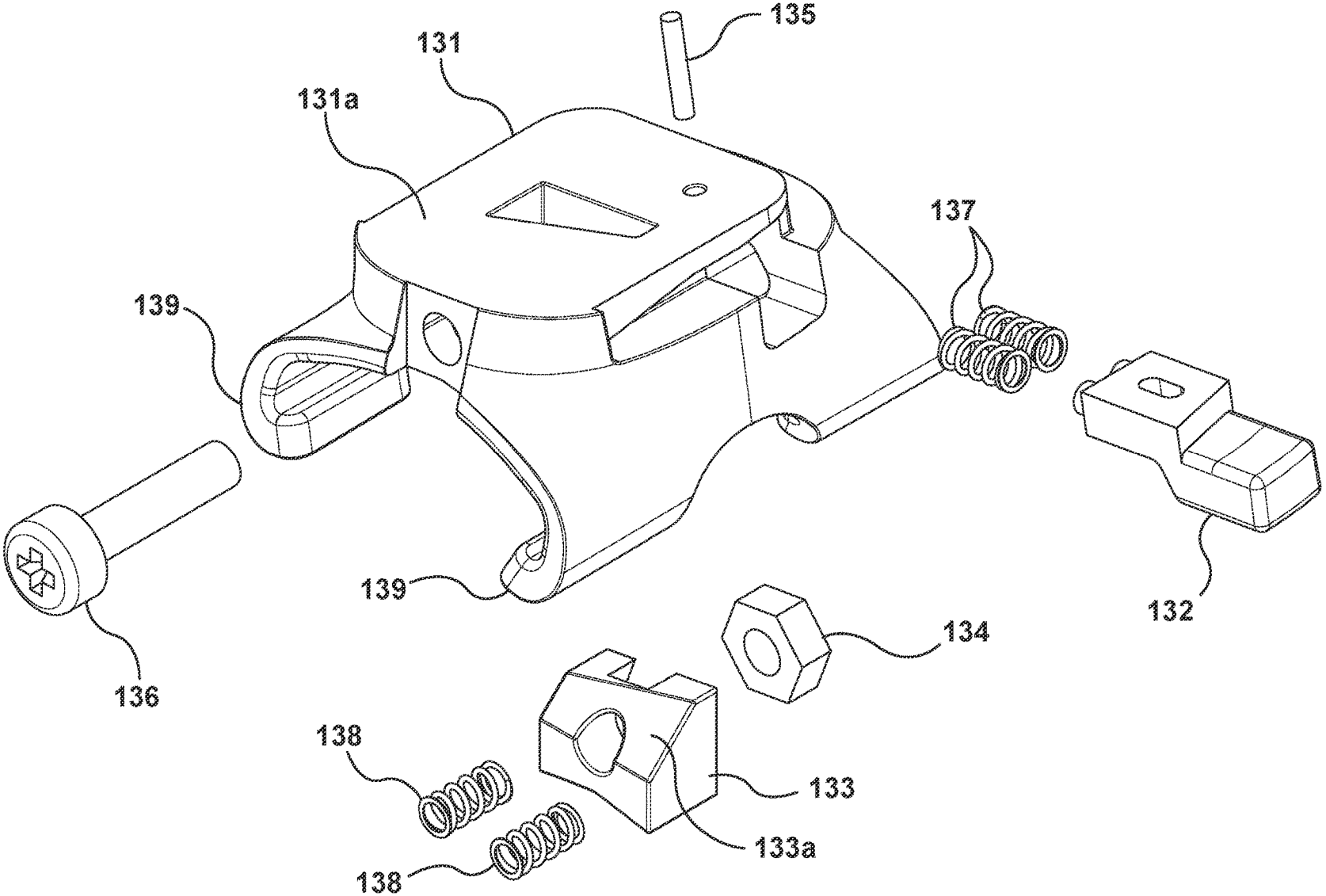
FIG. 31 is an exploded view of the bridge block assembly of FIG. 19.
Figure 32:
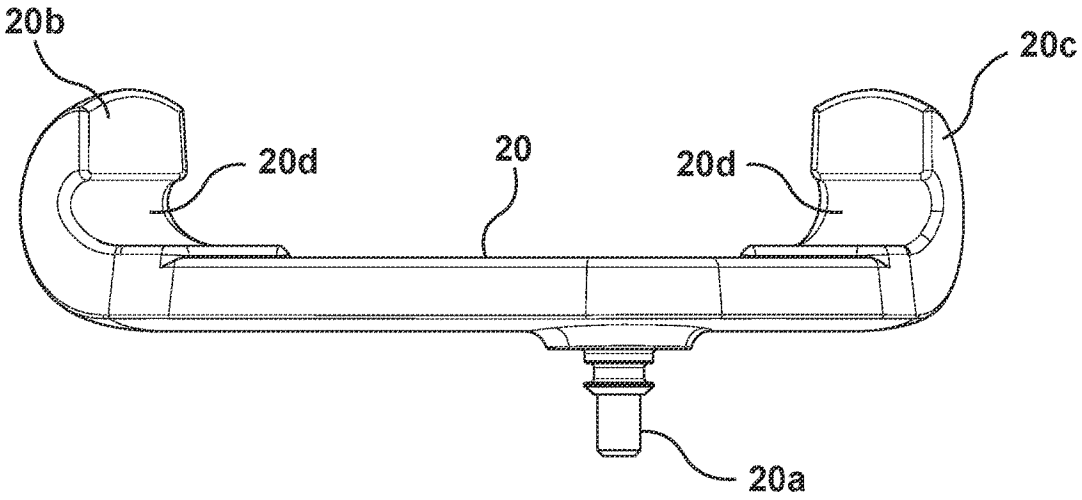
FIG. 32 is an end view of the fork of FIG. 19.
Figure 33:
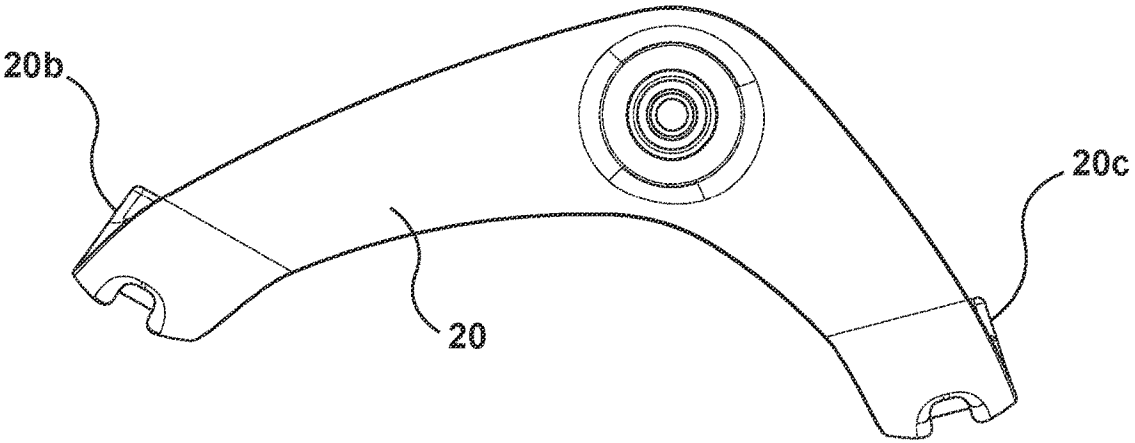
FIG. 33 is a bottom view of the fork of FIG. 32.
Figure 35:
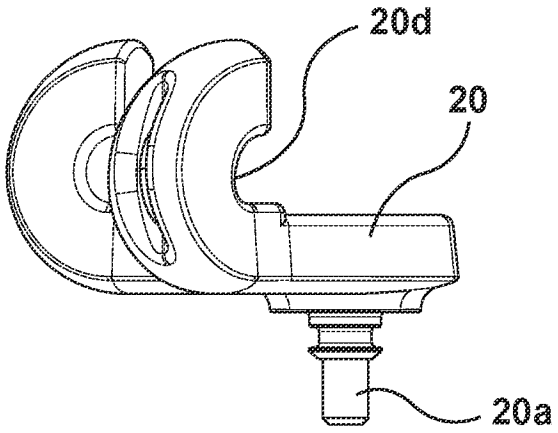
FIG. 35 is a second side view of the fork of FIG. 32.
Figure 34:
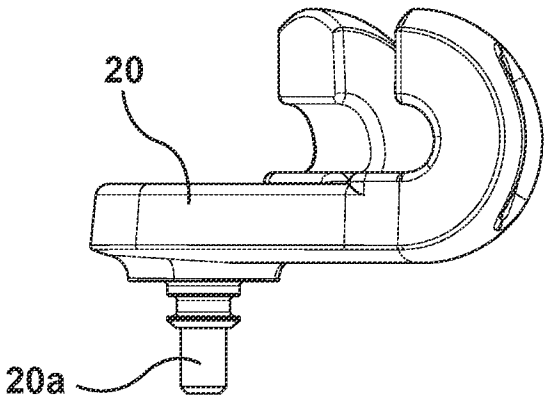
FIG. 34 is a first side view of the fork of FIG. 32.
Figure 36:
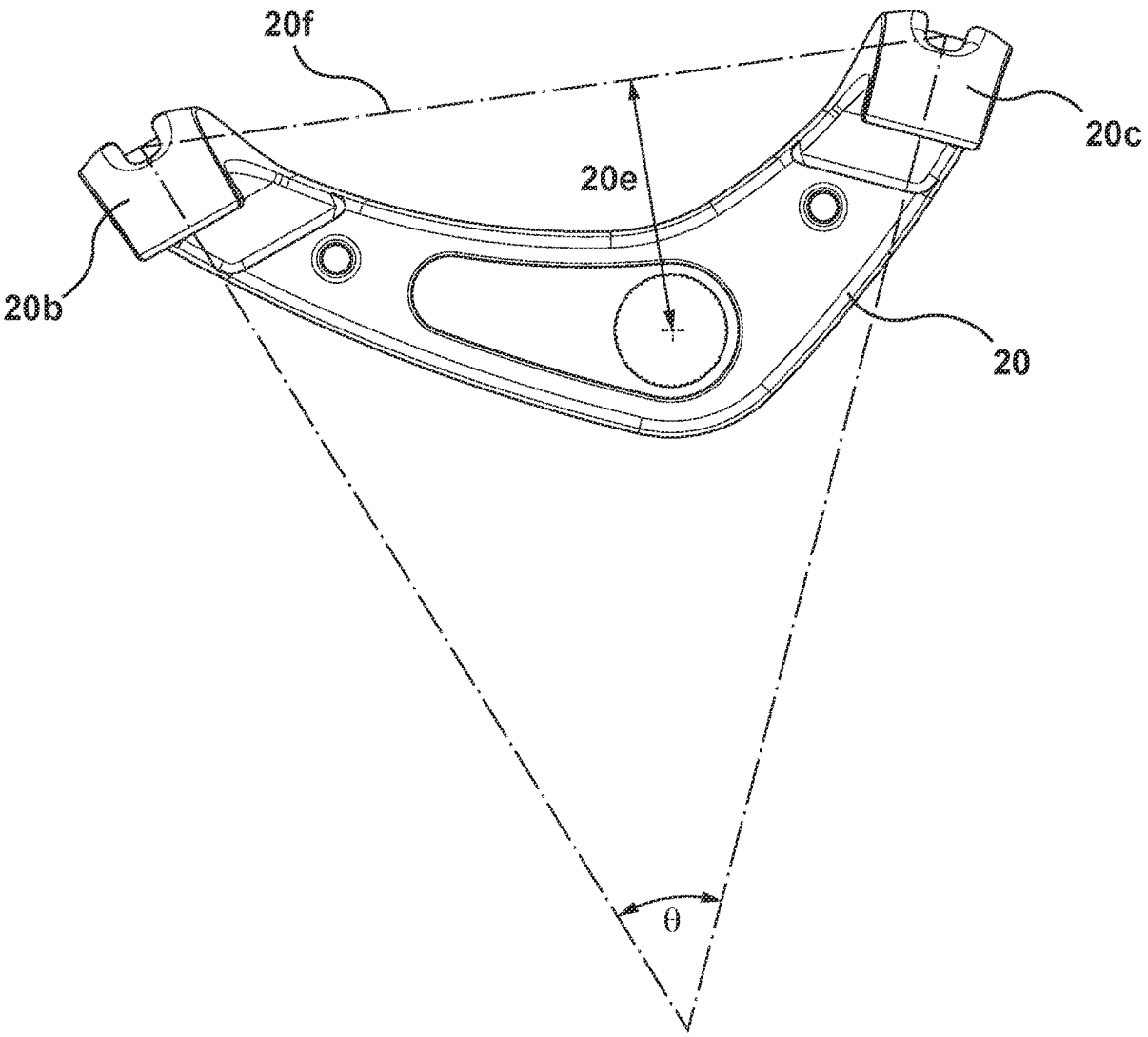
FIG. 36 is a top view of the fork of FIG. 32.

FIGS. 19-36 depict a shoulder rest in accordance with another embodiment of the present invention. FIGS. 19-25 depict the complete shoulder rest 10 of this further embodiment, whereas FIGS. 26-29 depict the shoulder-engaging pad 14 in isolation, FIGS. 30-31 depict a bridge block 131 in isolation, and FIGS. 32-36 depict one of the forks (feet) 20 in isolation.

In the embodiment illustrated in FIGS. 19-36, the shoulder rest 10 has an elongated bridge beam 12 defining a rigid support structure for supporting the shoulder-engaging pad 14 and the forks 20, 22. In the specific embodiment illustrated in FIGS. 19-25, the bridge beam is slightly curved (when viewed from the side in FIG. 21) and substantially straight when viewed from the top or bottom (see FIG. 24). The bridge beam in this specific embodiment has a generally uniform cross-section or transverse profile over most of its length while tapering toward each of its rounded ends 16, 18. It will be appreciated that the bridge beam may have other shapes and geometries for accommodating the inventive features described in this specification. The forks 20, 22 are rotationally mounted to the ends 16, 18 of the bridge beam 12 as shown in FIGS. 19-25. The forks have tines, prongs or fingers that are hooked or rounded to grip the purfling (decorative rim) of the violin or viola.

Figure 19:
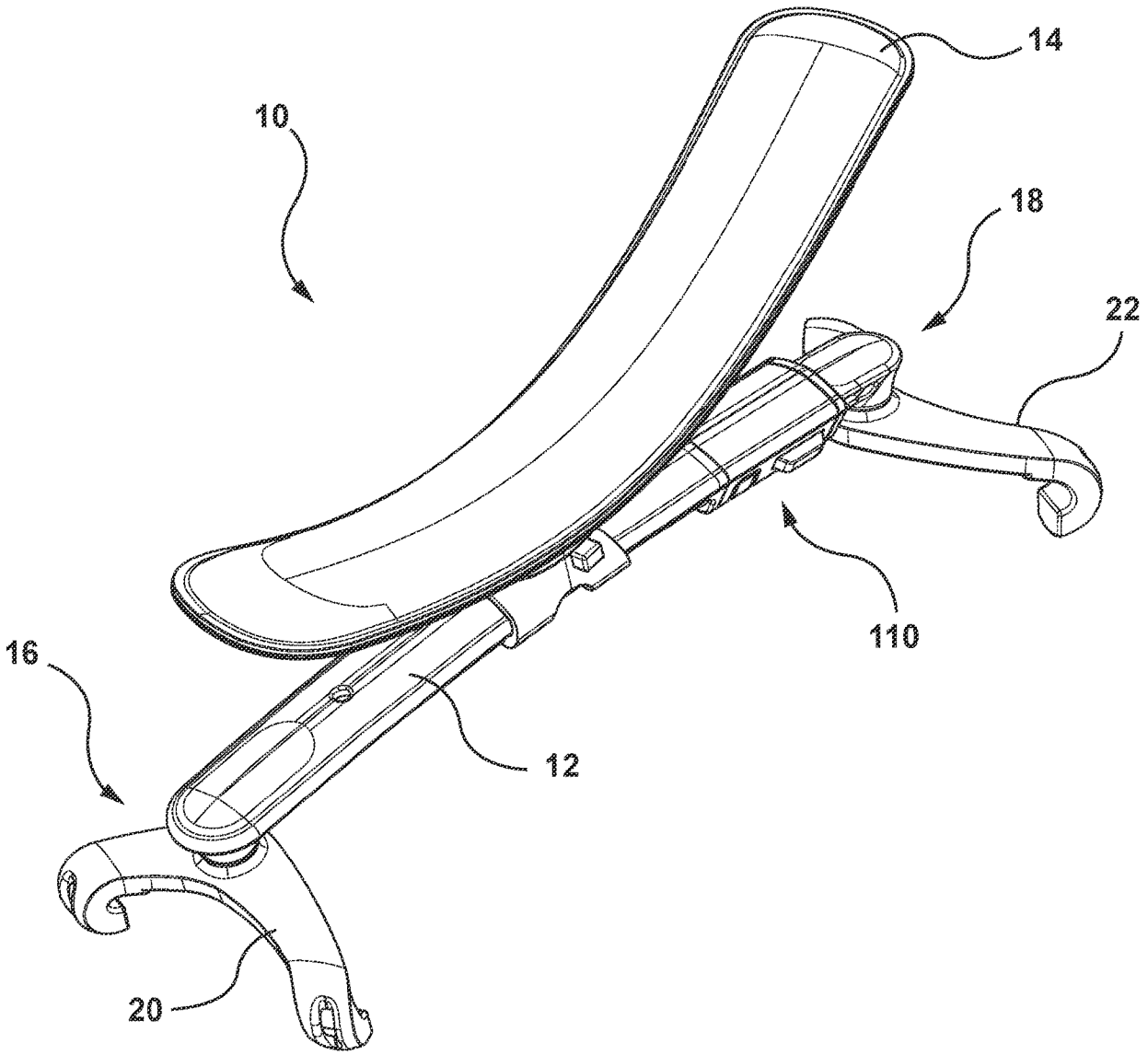
FIG. 19 is an isometric view of a shoulder rest in accordance with another embodiment of the present invention.
Figure 20:
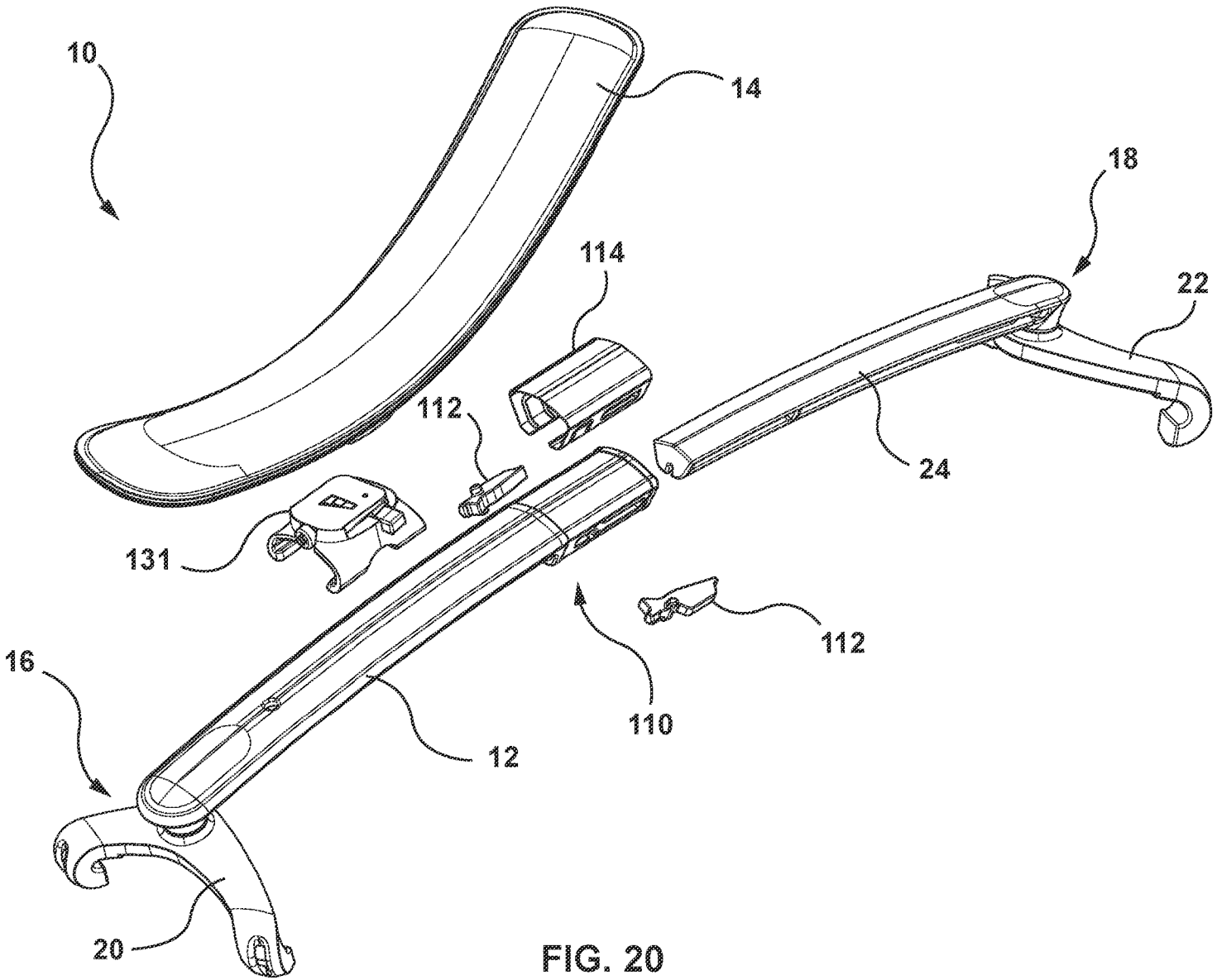
FIG. 20 is an exploded view of the shoulder rest of FIG. 19.
Figure 21:
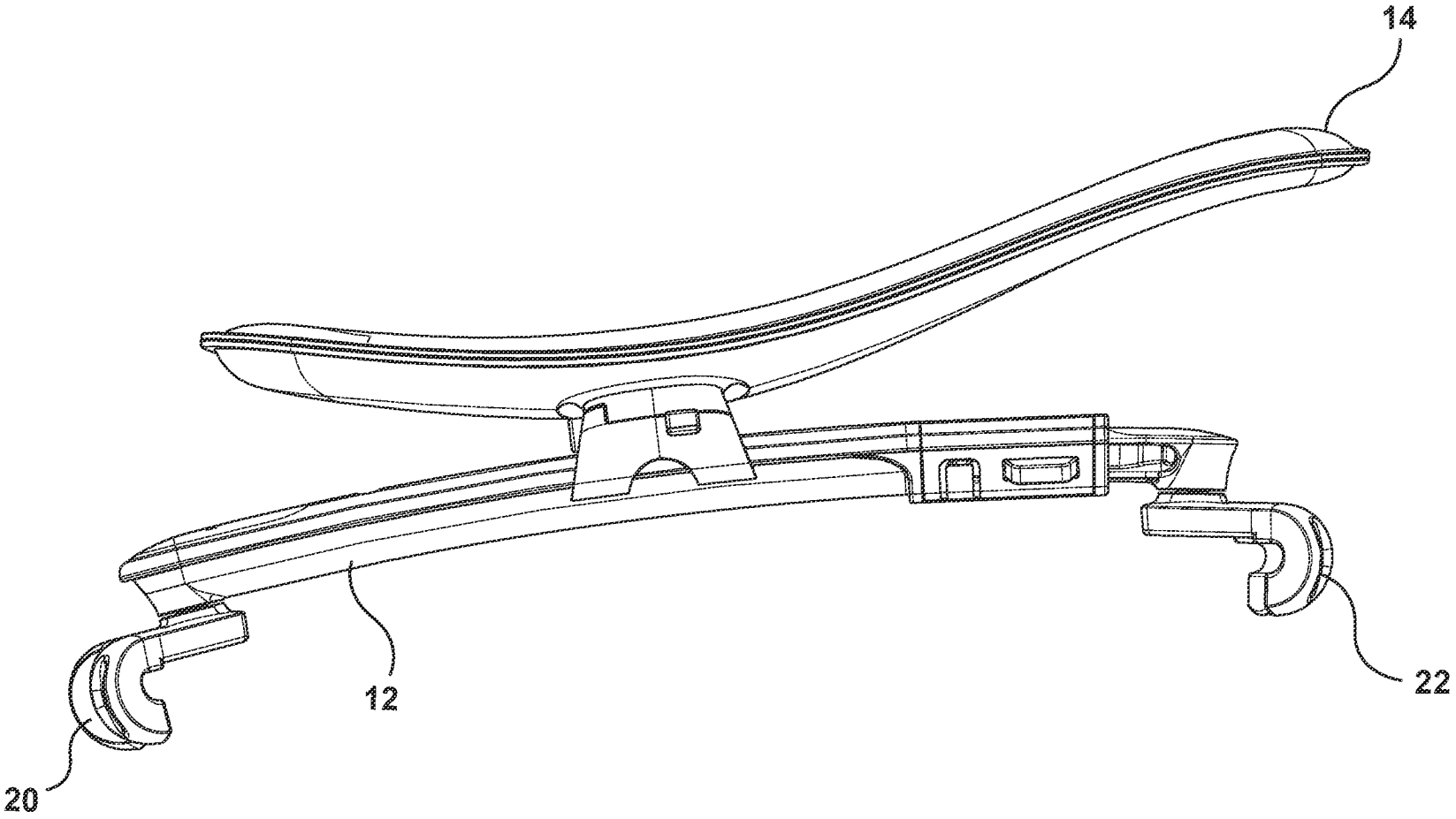
FIG. 21 is a side view of the shoulder rest of FIG. 19.
Figure 23:
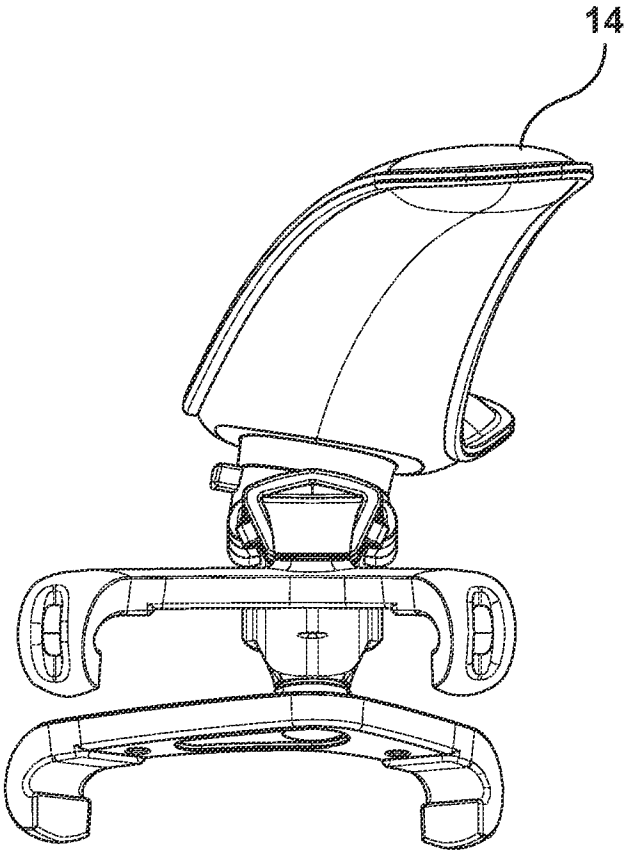
FIG. 23 is a second end view of the shoulder rest of FIG. 19.
Figure 22:
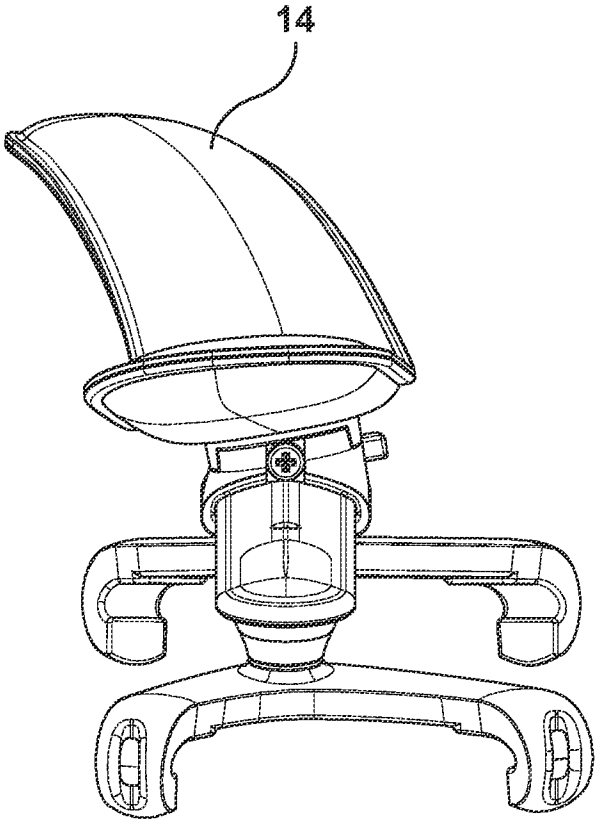
FIG. 22 is a first end view of the shoulder rest of FIG. 19.
Figure 24:
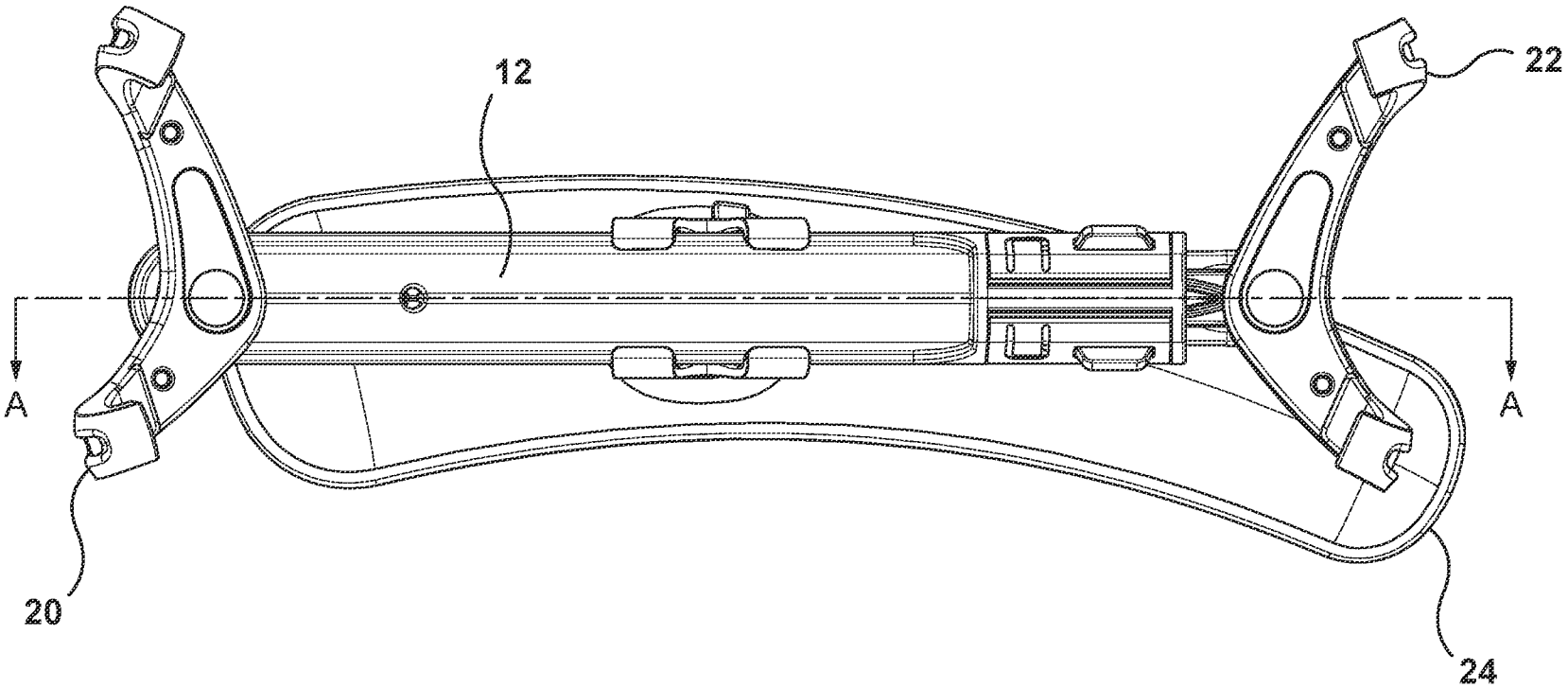
FIG. 24 is a top view of the shoulder rest of FIG. 19.
Figure 25:
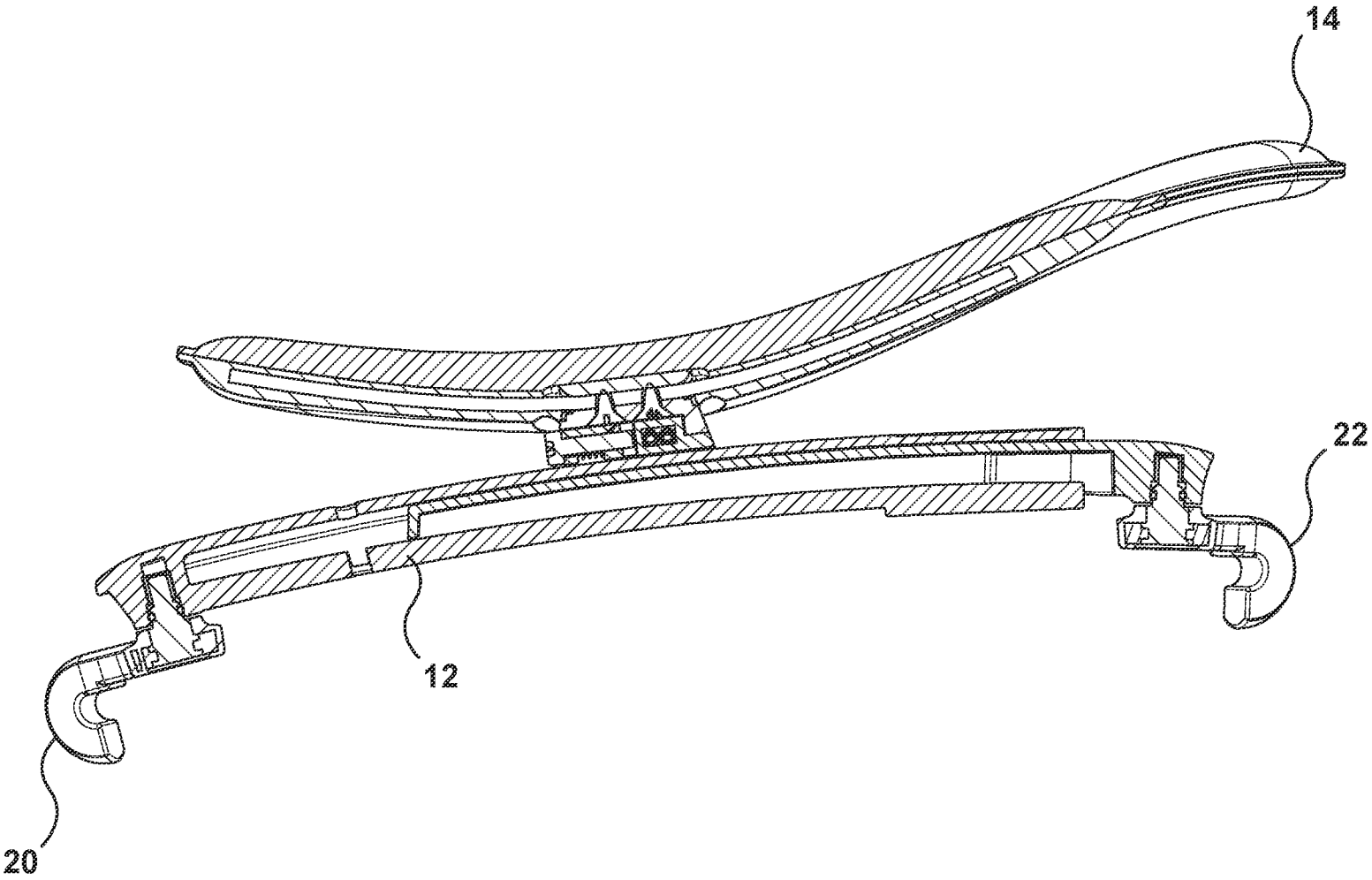
FIG. 25 is a cross-sectional view taken through section A-A in FIG. 24.
Figure 26:
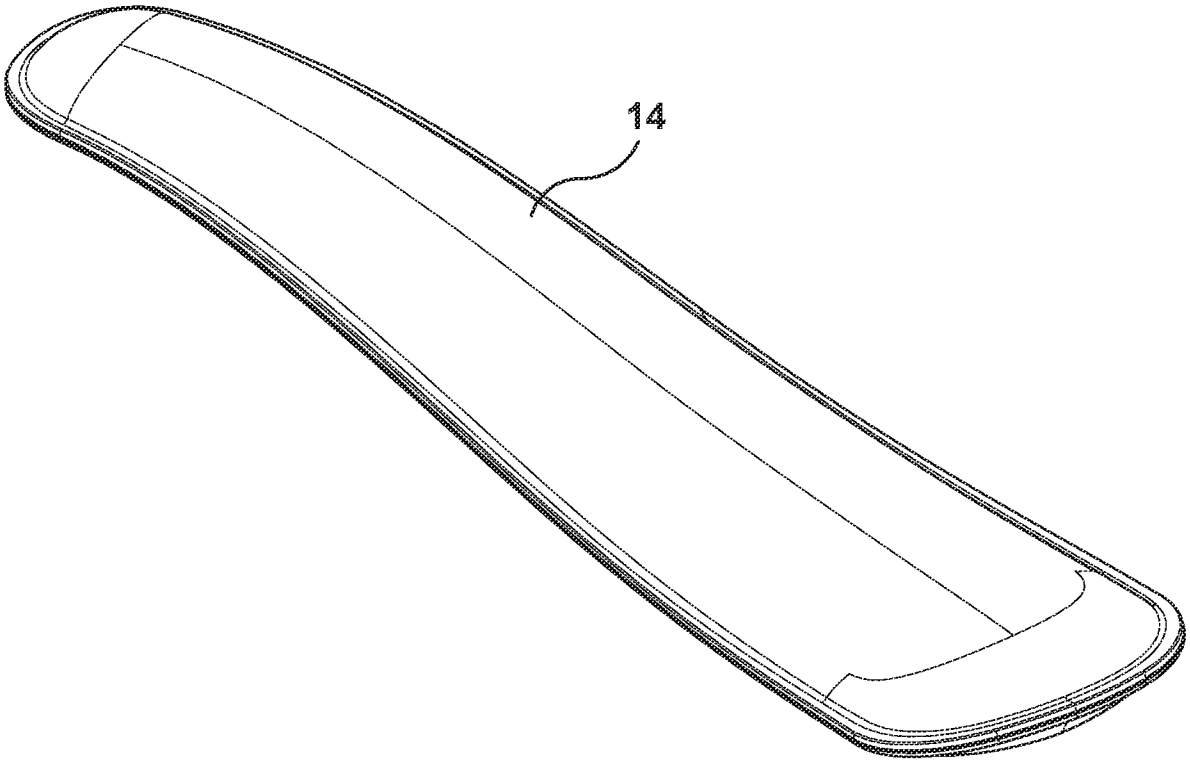
FIG. 26 is an isometric view of the pad of FIG. 19.
Figure 27:
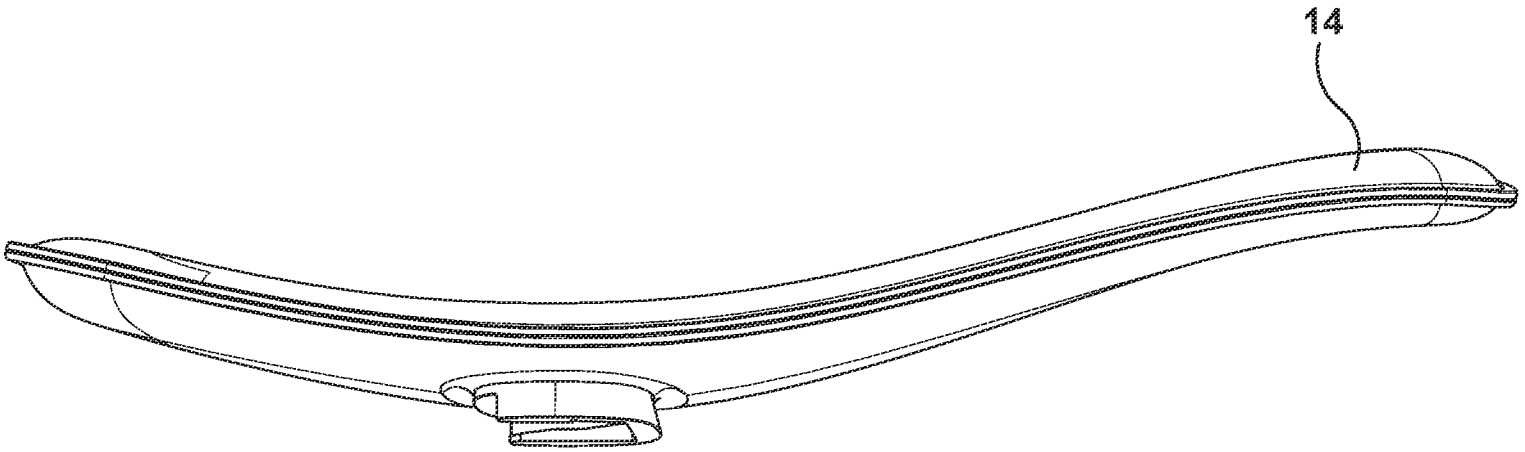
FIG. 27 is a side view of the pad of FIG. 26.
Figure 28:
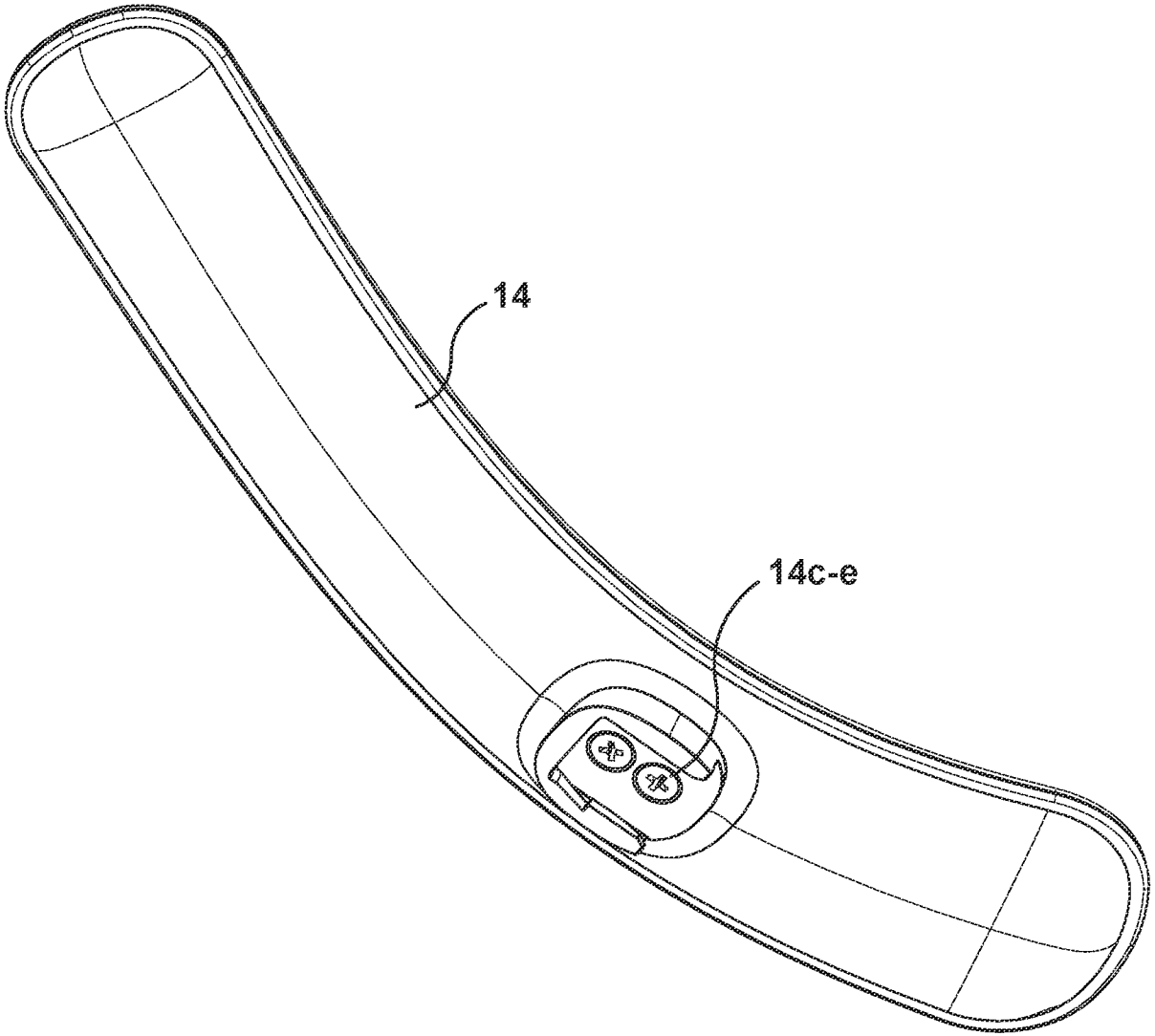
FIG. 28 is a top view of the pad of FIG. 26.
Figure 29:
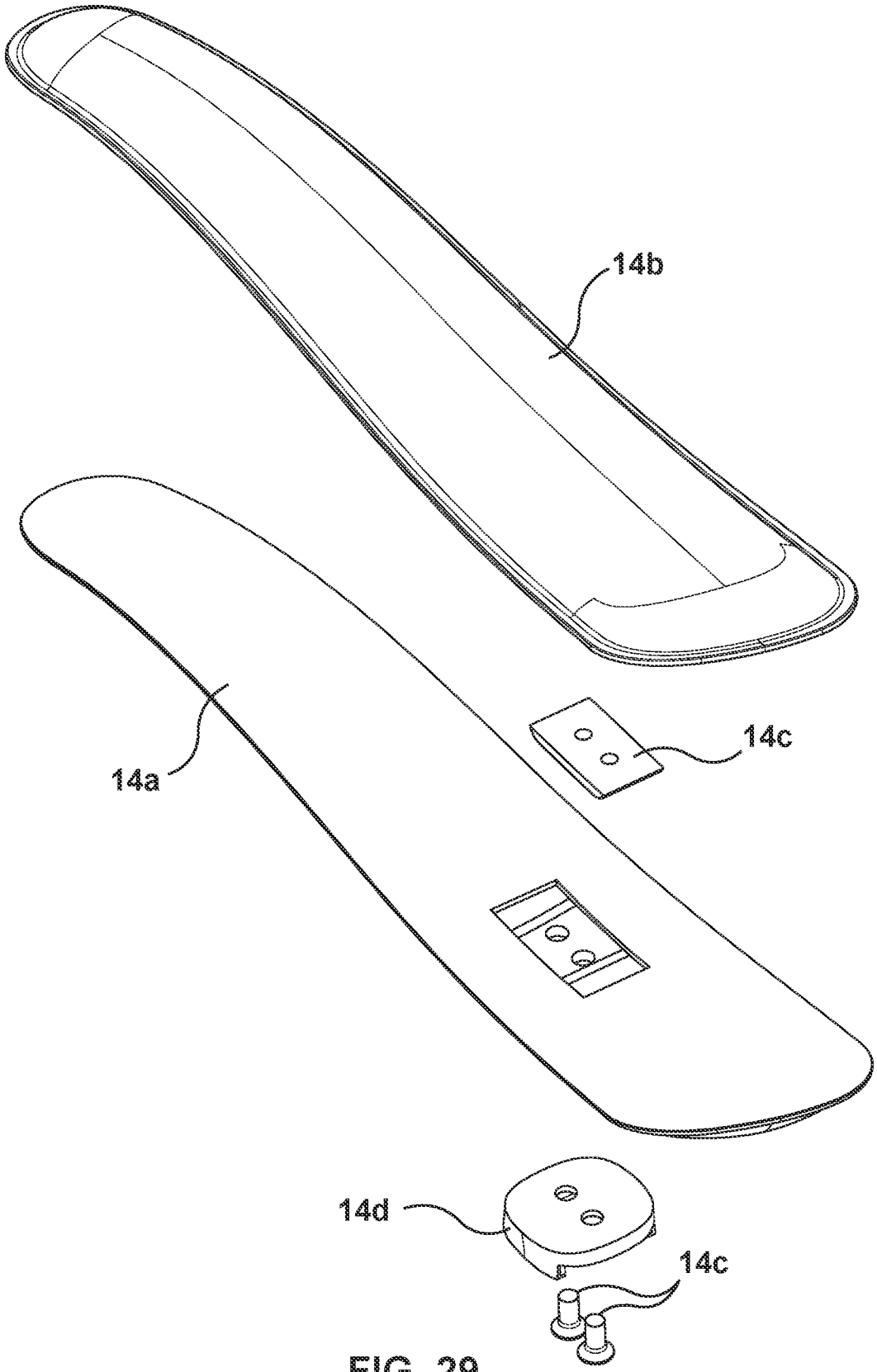
FIG. 29 is an exploded view of the pad of FIG. 26.

As illustrated in FIGS. 19-20, the bridge beam 12 is adjustable in length. The bridge beam has a length-adjustment mechanism, e.g. a ratchet mechanism, to adjust the distance between the forks to accommodate differently sized violins or violas. The bridge beam 12 includes the extensible foot beam 24 (also referred to herein as an inner bridge) that is extendable from within the outer bridge of the bridge beam. The inner bridge is thus shaped to slide or translate inside a correspondingly shaped bore or passageway within the outer bridge. The extensible foot beam (inner bridge) can be extended or retracted to adjust the length of the bridge beam to fit a particular violin or viola. The extensible foot beam is locked into place by the ratchet mechanism 110 shown in FIGS. 19-20. The ratchet mechanism 110 is defined by teeth on two opposite sides of the inner bridge and corresponding teeth on a pair of ratchet latches 112 that engage the teeth of the inner bridge. The ratchet latches are affixed to the outer bridge of the bridge beam 12 by a ratchet cover 114. The shoulder rest is adjustable in length by operating the ratchet mechanism 110. The forks 20, 24 are clamped to the purfling of the violin or viola by closing the ratchet mechanism 110, thereby locking the forks to the violin or viola. The ratchet mechanism is released or disengaged by depressing the ratchet latches whose teeth disengage from the correspondingly shaped and sized teeth on both sides of the inner bridge. The forks can then be pulled apart to release the shoulder rest from the violin or viola.

As illustrated in FIGS. 19-25, the shoulder rest 10 in this embodiment has a shoulder-engaging pad 14 (simply "pad") mounted to a bridge block 131 that can be slid over the bridge beam 12 to enable the pad 14 to be secured by the bridge block 131 to the bridge beam 12 in any suitable position along the bridge beam. In other words, the adjustability of the pad 14 relative to the bridge beam 12 is decoupled from the adjustability of the bridge beam 12 relative to the violin or viola. The pad 14 may also be removed from the bridge beam 12 while the bridge beam 12 remains affixed to the violin or viola and installed onto another bridge beam 12 on another instrument. Accordingly, the design of this shoulder rest 10 is modular, enabling the musician to detach a pad 14 from a bridge beam 12 and to mix and match different pads 14 with different bridge beams 12 to personalize or customize the appearance or configuration of the shoulder rest 10. Differently shaped and/or differently sized bridge blocks 131 may be provided to enable the violinist or violist to adjust the height and/or angle of the pad 14 relative to the bridge beam 12 to provide the most comfortable playing posture.

Details of the shoulder-engaging pad 14 are illustrated in FIGS. 26-29. The pad 14 in this embodiment is composed of a malleable core 14*a* and a cushion element 14*b* supported by the core 14*a*. The malleable core 14*a* is made of a freeform inelastically deformable material that is inelastically deformable into a plurality of shoulder-conforming shapes. The cushion element may be made of a foam, suede, leather, gel, or any other suitable material or combination of materials that is comfortable for the shoulder of the musician. As depicted in FIGS. 26-29, the pad 14 includes a mounting member that enables the pad to be mounted to the bridge block. The mounting member in this particular example is composed of a screw plate 14*c*, a pad adapter 14*d* and a pair of screws 14*e*. Another suitable mounting mechanism may be used in lieu of this particular one. In this particular embodiment, the pad adapter 14*d* is shaped and sized to attach to the top portion of the bridge block 131. More specifically, the underside of the pad adapter has a shape that is complementary to the shape of the top portion of the bridge block permitting the pad adapter to be snugly fitted to the top portion of the bridge block by sliding in a direction generally orthogonal to the main force exerted on the bridge block when playing the violin or viola so that the pad adapter does not come loose when playing. The pad adapter in this embodiment interlocks with the top portion of the bridge block using overlapping edges or rails that are tapered interlocking members that generate high frictional forces when fully fitted together.

Details of the bridge block 131 are depicted in FIGS. 30-31. The bridge block 131 is a variant of the bridge block 31 of FIGS. 1-6. In this particular embodiment, the bridge block 131 includes a flat surface 131 of the top portion of the bridge block 131. The bridge block 131 includes a bridge block latch 132, a clamp block 133, a nut 134, a latch pin 135, a clamp screw 136, a pair of latch springs 137 and a pair of clamp block springs 138. The bridge block latch 132 and latch springs 137, when depressed, disengage the adapter pad from the bridge block. The clamp screw 136, clamp block 133 having an angled surface 133*a*, nut 134 and clamp block springs 138 are used to secure, or lock, the bridge block to the bridge beam at a desired location along the bridge beam. The clamp screw 136 is tightened and untightened, either manually or using a screw driver. The clamp screw 136 is aligned with the bridge beam and the sliding direction of the bridge block. The clamp screw 136, when tightened, pulls the clamp block 133 into a sloped internal face which thus exerts a downward force on the clamp block, pressing it into the bridge beam. This lifts the bridge block 131, causing hooks 139 of the bridge block 131 to engage the the bridge beam 12. The hooks 139 keep the bridge block 131 slidably mounted to the bridge beam when the bridge block is unclamped. Tightening the clamp screw clamps the bridge block 131 to the bridge beam 12 at the desired position along the bridge beam. To loosen the bridge block 131 from the bridge beam 12, the clamp screw 136 is untightened. The bridge block 131 can then be slid to a different position along the bridge beam 12 and then re-clamped at that new position. This mechanism provides infinitesimal adjustability along the bridge beam.

Details of the forks 20, 22 are depicted in FIGS. 32-36. Only one of these forks (feet) is shown in these figures. The fork 20 is asymmetrical as shown in the figures. The distance from the stem 20*a* to a first finger 20*b* is different than the distance from stem 20*a* to a second finger 20*c*. Each finger defines a curved or rounded hook 20*d* to grip the purfling of the violin or viola. The fingers 20*b*, 20*c* are obliquely angled (at angle θ in FIG. 36) relative to each other such that they are neither parallel nor perpendicular to each other. The stem 20*a* of the fork 20 defining the axis of rotation is offset by an offset distance 20*e* from an imaginary line 20*f* extending between the fingers 20*b*, 20*c*. Another type of asymmetrical fork is disclosed in Applicant's earlier U.S. Pat. No. 7,385,124. Throughout this specification, it will be understood that the terms "feet" and "forks" are used synonymously.

For the purposes of interpreting this specification, when referring to elements of various embodiments of the present invention, the articles "a", "an", "the" and "said" are intended to mean that there are one or more of the elements. The terms "comprising", "including", "having", "entailing" and "involving", and verb tense variants thereof, are intended to be inclusive and open-ended by which it is meant that there may be additional elements other than the listed elements.

The embodiments of the invention described above are intended to be exemplary only. As will be appreciated by those of ordinary skill in the art, to whom this specification is addressed, many obvious variations, modifications, and refinements can be made to the embodiments presented herein without departing from the inventive concept(s) disclosed herein. The scope of the exclusive right sought by the applicant(s) is therefore intended to be limited solely by the appended claims.

The invention claimed is:

1. A shoulder rest for a violin or viola, the shoulder rest comprising:

a bridge beam having a first end and a second end, the bridge beam including a length-adjusting mechanism to adjust a length of the bridge beam;

a shoulder-engaging pad slidably adjustable relative to the bridge beam to adjust a position of the pad relative to the bridge beam independently of the length-adjusting mechanism of the bridge beam;

a first fork disposed at the first end of the bridge beam for gripping the violin or viola; and a second fork disposed at the second end of the bridge beam for gripping the violin or viola.

2. The shoulder rest of claim 1 further comprising a bridge block to which the pad is detachably mounted, the bridge block being shaped to slide over the bridge beam, wherein the bridge block has a clamping mechanism to clamp the bridge block to the bridge beam at any position along the bridge beam.

3. The shoulder rest of claim 2 wherein the clamping mechanism comprises a clamp screw aligned with the bridge beam and a clamp block having an angled surface such that when the clamp screw is tightened the clamp block causes the bridge block to clamp to the bridge beam.

4. The shoulder rest of claim 2 wherein the bridge block is shaped to receive a pad adapter of the pad.

5. The shoulder rest of claim 4 wherein the bridge block has a latch to disengage the pad adapter from the bridge block.

6. The shoulder rest of claim 4 wherein the bridge block and the pad adapter having interlocking tapered members that generate a high-frictional fit between the bridge block and the pad adapter.

7. The shoulder rest of claim 2 wherein the bridge block has hooks to engage the bridge beam such that the bridge block remains slidably mounted to the bridge beam when the bridge block is unclamped from the bridge beam.

8. The shoulder rest of claim 1 wherein the length-adjusting mechanism is a ratchet mechanism.

9. The shoulder rest of claim 8 wherein the bridge beam comprises an extensible foot beam, defining an inner bridge having teeth, that extends from an outer bridge of the bridge beam, and is lockable by the ratchet mechanism.

10. The shoulder rest of claim 8 further comprising two ratchet latches having teeth to disengage the teeth of the ratchet latches from the teeth disposed along two sides of the inner bridge.

11. The shoulder rest of claim 1 wherein the pad is a freeform inelastically deformable material.

12. A shoulder rest for a violin or viola, the shoulder rest comprising:

a bridge beam having a first end and a second end;

a shoulder-engaging pad comprising a freeform inelastically deformable material that is inelastically deformable into a plurality of shoulder-conforming shapes, wherein the freeform inelastically deformable material comprises a malleable core and a cushion element on the malleable core;

a first foot disposed at the first end for gripping the violin or viola; and a second foot disposed at the second end for gripping the violin or viola.

13. The shoulder rest of claim 12 wherein the pad comprises a pad adapter releasably mountable to a bridge block that is slidably secured to the bridge beam.

14. The shoulder rest of claim 13 wherein the bridge block is shaped to slide over the bridge beam, wherein the bridge block has a clamping mechanism to clamp the bridge block to the bridge beam at any position along the bridge beam.

15. The shoulder rest of claim 14 wherein the clamping mechanism comprises a clamp screw aligned with the bridge beam and a clamp block having an angled surface such that when the clamp screw is tightened the clamp block causes the bridge block to clamp to the bridge beam.

16. The shoulder rest of claim 13 wherein the bridge block comprises a latch to release the pad adapter from the bridge block.

* * * * *